US008195471B2

(12) United States Patent
Oshikiri

(10) Patent No.: US 8,195,471 B2
(45) Date of Patent: Jun. 5, 2012

(54) SAMPLING RATE CONVERSION APPARATUS, CODING APPARATUS, DECODING APPARATUS AND METHODS THEREOF

(75) Inventor: Masahiro Oshikiri, Osaka (JP)

(73) Assignee: Panasonic Corporation, Osaka (JP)

( * ) Notice: Subject to any disclaimer, the term of this patent is extended or adjusted under 35 U.S.C. 154(b) by 295 days.

(21) Appl. No.: 12/708,290

(22) Filed: Feb. 18, 2010

(65) Prior Publication Data

US 2010/0161321 A1 Jun. 24, 2010

Related U.S. Application Data

(63) Continuation of application No. 10/573,812, filed on Mar. 28, 2006, now Pat. No. 7,756,711.

(30) Foreign Application Priority Data

Sep. 30, 2003 (JP) ..... 2003-341717

(51) Int. Cl.
*G10L 19/00* (2006.01)

(52) U.S. Cl. ..... 704/500; 704/200; 704/212; 370/468

(58) Field of Classification Search ..... 704/500, 704/200, 212; 370/468
See application file for complete search history.

(56) References Cited

U.S. PATENT DOCUMENTS

| | | | | |
|---|---|---|---|---|
| 5,983,172 | A | 11/1999 | Takashima | |
| 6,226,616 | B1 | 5/2001 | You | |
| 6,370,507 | B1 | 4/2002 | Grill | |
| 6,680,972 | B1 | 1/2004 | Liljeryd | |
| 6,681,209 | B1 | 1/2004 | Schmidt | |
| 7,346,007 | B2 | 3/2008 | Curcio | |
| 8,069,040 | B2 * | 11/2011 | Vos | 704/222 |
| 2002/0154656 | A1 | 10/2002 | Kitchin | |
| 2003/0093271 | A1 | 5/2003 | Tsushima | |
| 2003/0093279 | A1 | 5/2003 | Malah | |
| 2003/0108108 | A1 | 6/2003 | Katayama | |
| 2003/0125889 | A1 | 7/2003 | Sato | |
| 2004/0138876 | A1 | 7/2004 | Kallio | |
| 2004/0174911 | A1 * | 9/2004 | Kim et al. | 370/538 |
| 2005/0187759 | A1 | 8/2005 | Malah | |

(Continued)

FOREIGN PATENT DOCUMENTS

EP 1 298 643 4/2003

(Continued)

OTHER PUBLICATIONS

International Search Report dated Jan. 11, 2005.

(Continued)

*Primary Examiner* — Daniel D Abebe
(74) *Attorney, Agent, or Firm* — Dickinson Wright PLLC

(57) ABSTRACT

A coding apparatus reduces a circuit scale and the amount of coding processing calculation. A frequency domain conversion section performs a frequency analysis of the signal sampled at a sampling rate Fx with an analysis length of 2·Na and calculates first spectrum S1(k)(0≦k<Na). A band extension section extends the effective frequency band of first spectrum S1(k) to 0≦k<Nb so that a new spectrum can be assigned to the extended area following to the frequency k=Na of first spectrum S1(k). An extended spectrum assignment section assigns extended spectrum S1'(k)(Na≦k<Nb) input to the extended frequency band from the outside. A spectral information specification section outputs information necessary to specify extended spectrum S1'(k) out of the spectrum given from the extended spectrum assignment section as a code.

19 Claims, 25 Drawing Sheets

U.S. PATENT DOCUMENTS

2008/0021712 A1* 1/2008 Fejzo ..... 704/500

FOREIGN PATENT DOCUMENTS

| | | |
|---|---|---|
| JP | 8-263096 | 10/1996 |
| JP | 09153811 | 6/1997 |
| JP | 2003-502704 | 1/2000 |
| JP | 2000 068948 | 3/2000 |
| JP | 2001-521648 | 11/2001 |
| JP | 2001 356788 | 12/2001 |
| JP | 2003-216199 | 7/2003 |
| JP | 2003-241799 | 8/2003 |
| WO | 9857436 | 12/1998 |

OTHER PUBLICATIONS

Yuichiro Takamizawa et al., "MPEG-4 Audio Taliki Kakucho Decoder Software no Kaihatsu," 2003 Nen The Institute of Electronics, Information and Communication Engineers Sogo Taikai Keen Ronbunshu, p. 177, Mar. 3, 2003.

Masahiro Oshikiri et al., "Jikan—Shuhasu Ryoiki no Keisu no Tekio Sentaku Vector Ryoshika o Mochiita 10kHz Taiiki Scalable Fugoka Hoshiki," FIT 2003 Joho Kagaku Gijutsu Forum Koen Ronbunshu, pp. 239-240, Aug. 25, 2003.

Masahiro Oshikiri et al., "Pitch Filtering ni Yoru Taiiki Kakucho Gijutsu o Mochiita 7/10/15kHz Taiiki Scalable Onsei Fugoka Hoshiki," The Acoustical Society of Japan (ASJ) 2004 Nen Shunki Kenkyu Happyokai Koen Ronbunshu -I-, pp. 327-328, Mar. 17, 2004.

European Search Report dated May 21, 2008.

M. Oshikiri, et al.,"Efficient spectrum coding for super-wideband speech and its application to 7/10/15 KHz bandwidth scalable coders," Acoustics, Speech, and Signal Processing, 2004. Proceedings. (ICASSP '04). IEEE International Conference on Montreal, Quebec, Canada, May 17-21, 2004, Piscataway, NJ, USA, IEEE, vol. 1, May 17, 2004, pp. 481-484.

European Office Action dated Apr. 2, 2009.

Moulines E. et al, "Non-parametric techniques for pitch-scale and timescale modification of speech," Speech Communication, Elsevier Science Publishers, Amsterdam, vol. 16, Feb. 1, 1995, pp. 175-205.

Yuichiro Takamizawa et al, "MPEG-4 Audio Taiiki Kakucho Decoder Software no Kaihatsu," 2003 Nen The Institute of Electronics, Information and Communication Engineers Sogo Taikai Koen Ronbunshu, p. 177, Mar. 3, 2003, with partial English translation.

Masahiro Oshikiri et al., "Jikan—Shuhasu Ryoiki no Keisu no Tekio Sentaku Vector Ryoshika o Mochiita 10kHz Taiiki Scalable Fugoka Hoshiki," FIT 2003 Joho Kagaku Gijutsu Forum Keen Ronbunshu, pp. 239-240, Aug. 25, 2003, with partial English translation.

Japanese Office Action dated Jul. 14, 2009 in a corresponding Japanese Patent Application.

Yuichiro Takamizawa et al., "Implementation of MPEG-4 Audio Bandwidth Extension Decoder Software," 2003 Nen The Institute of Electronics, Information and Communication Engineers Sago Taikai Koen Ronbunshu, p. 177, Mar. 3, 2003, with partial English translation.

Masahiro Oshikiri et al., "A 10 kHz bandwidth scalable codec using adaptive selection VQ of time-frequency coefficients," FIT 2003 Joho Kagaku Gijutsu Forum Koen Ronbunshu, pp. 239-240, Aug. 25, 2003, with partial English translation.

Masahiro Oshikiri et al. "Pitch Filtering ni Yoru Taiiki Kakucho Gijutsu o Mochita 7/10/15kHz Taikai Scalable Onset Fugoka Hoshiki," The Accoustical Society of Japan (ASJ) 2004 Nen Shunki Kenkyu Happyokai Koen Ronbunshu —I-, pp. 327-328, Mar. 17, 2004.

Japanese Office Action dated Dec. 15, 2009.

M. Oshikiri, H. Ehara, K Yoshida, "A Scalable Coder Designed for 10 -kHz Bandwidth Speech," IEEE Speech Coding Workshop Proceedings, Oct. 2002, pp. 111-113.

* cited by examiner

SAMPLING RATE CONVERSION APPARATUS, CODING APPARATUS, DECODING APPARATUS AND METHODS THEREOF

This is a continuation of application Ser. No. 10/573,812 filed Mar. 28, 2006, which is a 371 application of PCT/JP2004/014215 filed Sep. 29, 2004, which is based on Japanese Application No. 2003-341717 filed Sep. 30, 2003, the entire contents of each of which are incorporated by reference herein.

TECHNICAL FIELD

The present invention relates to a sampling rate conversion apparatus, coding apparatus, decoding apparatus and methods thereof.

BACKGROUND ART

Nowadays, there are many different sampling rates such as 44.1 kHz for a compact disk, 32 kHz or 48 kHz for DAT (Digital Audio Tape), digital VCR or satellite television, 48 kHz or 96 kHz for a DVD audio signal. Therefore, when an internal sampling rate of a decoder of a reproduction apparatus or a recording apparatus is different from the sampling rate of data to be decoded, it is necessary to change the sampling rate. One such conventional apparatus that converts this sampling rate is described, for example, in Patent Document 1.

Also, in recent years, transmission path capacities on a network have been significantly improved with the popularity of ADSL (Asymmetric Digital Subscriber Line) and optical fibers in a wired system, practical use of W-CDMA (Wideband-Code Division Multiple Access) and wireless LAN in a wireless system or the like, and in line with this trend, there are demands for realization of high sense of realism and high quality by expanding bandwidth of signal in voice communications.

At present, there are G.726, 729 or the like which are standardized by ITU (International Telecommunication Union) as typical schemes for coding a narrow band signal. Furthermore, examples of typical methods for coding a wideband signal include G722, G722.1 of ITU-T (International Telecommunication Union Telecommunication Standardization Sector) and AMR-WB or the like of 3GPP (The 3rd Generation Partnership Project).

Moreover, with the intention of being used in various network environments such as an IP (Internet Protocol) network, the voice coding scheme is recently required to realize a scalable function. The scalable function means the function capable of decoding a voice signal even from part of a code. With this scalable function, it is possible to reduce the occurrence frequency of packet loss by decoding a high quality voice signal using all codes in a communication path under good conditions and transmitting only part of the code in a communication path under bad conditions.

It is also possible to produce effects such as an increase in efficiency of network resources in multicast communication.

To realize a high quality coding scheme having this scalable function, coding must be performed using signals at various sampling rates. For example, if a signal having a sampling rate of 8 kHz is coded using a method such as G.726, G.729 or the like standardized in ITU-T and its error signal is further coded in an area of sampling rate of 16 kHz, it is possible to improve quality through an extension of the signal bandwidth and realize scalability.

FIG. 1 is a block diagram showing the typical configuration of a coding apparatus that performs scalable coding. In this example, the number of layers is N=3 and the sampling rate of a signal layer n is represented FS(n) and suppose FS(1)=16 [kHz], FS(2)=24 [kHz] and FS(3)=32 [kHz].

An acoustic signal (voice signal, audio signal or the like) input to downsampling section 12 through input terminal 11 is downsampled from a sampling frequency of 32 kHz to 16 kHz and given to first layer coding section 13. First layer coding section 13 determines a first code so that perceptual distortion between the input acoustic signal and the decoded signal which is generated after the coding becomes a minimum. This first code is sent to multiplexing section 26 and also sent to first layer decoding section 14. First layer decoding section 14 generates a first layer decoded signal using the first code. Upsampling section 15 performs upsampling on the sampling frequency of the first layer decoded signal from 16 kHz to 24 kHz and gives the upsampled signal to subtractor 18 and adder 21.

Furthermore, an acoustic signal input to downsampling section 16 through input terminal 11 is downsampled from a sampling frequency of 32 kHz to 24 kHz and given to delay section 17. Delay section 17 delays the downsampled signal by a predetermined duration. Subtractor 18 calculates the difference between the output signal of delay section 17 and the output signal of upsampling section 15, generates a second layer residual signal and gives it to second layer coding section 19. Second layer coding section 19 performs coding so that the perceptual quality of the second layer residual signal is improved, determines a second code and gives this second code to multiplexing section 26 and second layer decoding section 20. Second layer decoding section 20 performs decoding processing using the second code and generates a second layer decoded residual signal. Adder 21 calculates the sum between above described first layer decoded signal and the second layer decoded residual signal and generates a second layer decoded signal. Upsampling section 22 performs upsampling on the sampling frequency of the second layer decoded signal from 24 kHz to 32 kHz and gives this signal to subtractor 24.

Moreover, an acoustic signal input to delay section 23 through input terminal 11 is delayed by a predetermined duration and given to subtractor 24. Subtractor 24 calculates the difference between the output signal of delay section 23 and the output signal of upsampling section 22 and generates a third layer residual signal. This third layer residual signal is given to third layer coding section 25. Third layer coding section 25 performs coding on the third layer residual signal so that its perceptual quality is improved, determines a third code and gives the code to multiplexing section 26. Multiplexing section 26 multiplexes the codes obtained from first layer coding section 13, second layer coding section 19 and third layer coding section 25 and outputs the multiplexing result through output terminal 27.

Patent Document 1: Unexamined Japanese Patent Publication No. 2000-68948

DISCLOSURE OF INVENTION

Problems to be Solved by the Invention

However, as mentioned above, the coding apparatus which realizes a scalable function based on a time domain coding scheme such as G.726, 729, AMR-WB or the like needs to convert sampling rates of various signals (downsampling section 12, upsampling section 15, downsampling section 16 and upsampling section 22 in the above described example), which results in a problem that the configuration of the coding apparatus becomes complicated and the amount of coding processing calculation also increases. Furthermore, the circuit configuration of the decoding apparatus that decodes a signal coded by this coding apparatus also becomes complicated and the amount of decoding processing calculation increases.

It is an object of the present invention to provide a sampling rate conversion apparatus and coding apparatus that can reduce a circuit scale and also reduce the amount of coding processing calculation, a decoding apparatus that decodes a signal coded by this coding apparatus and methods for these apparatuses.

Solutions to the Problem

The present invention extends an effective frequency band of a spectrum in a frequency domain instead of performing a sampling conversion (especially upsampling) in a time domain and thereby obtains a signal equivalent to a case where a time domain signal is upsampled.

The sampling rate conversion apparatus of the present invention adopts a configuration comprising a conversion section that converts an input time domain signal to a frequency domain and obtains a first spectrum, an extension section that extends the frequency band of the first spectrum obtained and an insertion section that inserts a second spectrum in the extended frequency band of the first spectrum after the extension.

According to this configuration, the input time domain signal is converted to a frequency domain signal and the frequency band of the spectrum obtained is extended, and it is possible to thereby obtain a signal equivalent to a signal upsampled in the time domain. Furthermore, it is also possible to reduce the circuit scale of the coding apparatus and also reduce the amount of coding processing calculation.

The coding apparatus of the present invention adopts a configuration comprising a conversion section that performs a frequency analysis of a signal having an input sampling frequency of Fx with an analysis length of 2·Na and obtains a first spectrum of an Na point, an extension section that extends the frequency band of the first spectrum obtained to an Nb point and a coding section that specifies a second spectrum inserted in the extended frequency band of the first spectrum after the extension and outputs a code representing this second spectrum.

This configuration allows a spectrum having a sampling rate of FS=Fx·Nb/Na to be obtained without performing any sampling conversion in the time domain.

In the coding apparatus of the present invention in the above described configuration, the second spectrum is generated based on the first spectrum.

According to this configuration, it is possible to generate an extended spectrum based on information obtained by the decoder and thereby realize a low bit rate.

In the coding apparatus of the present invention in the above described configuration, the second spectrum is determined so as to resemble the spectrum included in a frequency band of $Na \leqq k < Nb$ out of the spectrum obtained by the frequency analysis of the input signal having a sampling frequency of Fy at a 2·Nb point.

According to this configuration, it is possible to determine the extended spectrum relative to the spectrum of an original signal and thereby obtain a more accurate extended spectrum.

In the coding apparatus of the present invention in the above described configuration, the coding section divides the frequency band of $Na \leqq k < Nb$ into two or more subbands and outputs codes representing the second spectrum in subband units.

According to this configuration, it is possible to obtain the effect of generating a code having a scalable function.

In the coding apparatus of the present invention in the above described configuration, the signal having a sampling frequency of Fx is a signal decoded with a lower layer of hierarchical coding.

According to this configuration, the present invention can be applied to hierarchical coding made up of a coding section having a plurality of layers and the hierarchical coding can be realized only with a minimum sampling conversion.

The decoding apparatus of the present invention adopts a configuration comprising an acquisition section that performs a frequency analysis of a signal having a sampling frequency of Fx with an analysis length of 2·Na and acquires a first spectrum in a frequency band of $0 \leqq k < Na$, a decoding section that receives a code and decodes a second spectrum in a frequency band of $Na \leqq k < Nb$, a generation section that combines the first spectrum and the second spectrum and generates a spectrum in a frequency band of $0 \leqq k < Nb$, and a conversion section that converts the spectrum included in the frequency band of $0 \leqq k < Nb$ to a time domain signal.

According to this configuration, it is possible to decode a code generated by the coding apparatus according to any one of the above described configurations.

In the decoding apparatus of the present invention in the above described configuration adopts a configuration, the second spectrum is generated based on the spectrum in a frequency band of $0 \leqq k < Na$.

According to this configuration, it is possible to decode the code using the coding method of generating an extended spectrum based on information obtained with the decoder and thereby realize a low bit rate.

The decoding apparatus of the present invention in the above described configuration adopts a configuration, further comprising a section that inserts a specified value into a high-frequency part of the spectrum after the combination or discards a high-frequency part of the spectrum after the combination so that the frequency bandwidth of the spectrum after the combination obtained by the generation section matches a predetermined bandwidth.

According to this configuration, a decoded signal is generated after adding processing of making the bandwidth of the spectrum constant even when the bandwidth of the spectrum received changes due to factors such as a condition of a network or the like, and it is possible to thereby generate a decoded signal at a desired sampling rate stably.

In the decoding apparatus of the present invention in the above described configuration, the signal having a sampling frequency of Fx is a signal decoded with a lower layer in hierarchical coding.

According to this configuration, it is possible to decode a code obtained through hierarchical coding made up of the coding section having a plurality of layers.

Advantageous Effect of the Invention

According to the present invention, it is possible to reduce the circuit scale of the coding apparatus and also reduce the amount of coding processing calculation. It is also possible to provide a decoding apparatus that decodes a signal coded by this coding apparatus.

BEST MODE FOR CARRYING OUT THE INVENTION

Now, embodiments of the present invention will be described in detail with reference to the accompanying drawings.

(Embodiment 1)

Figure 1:
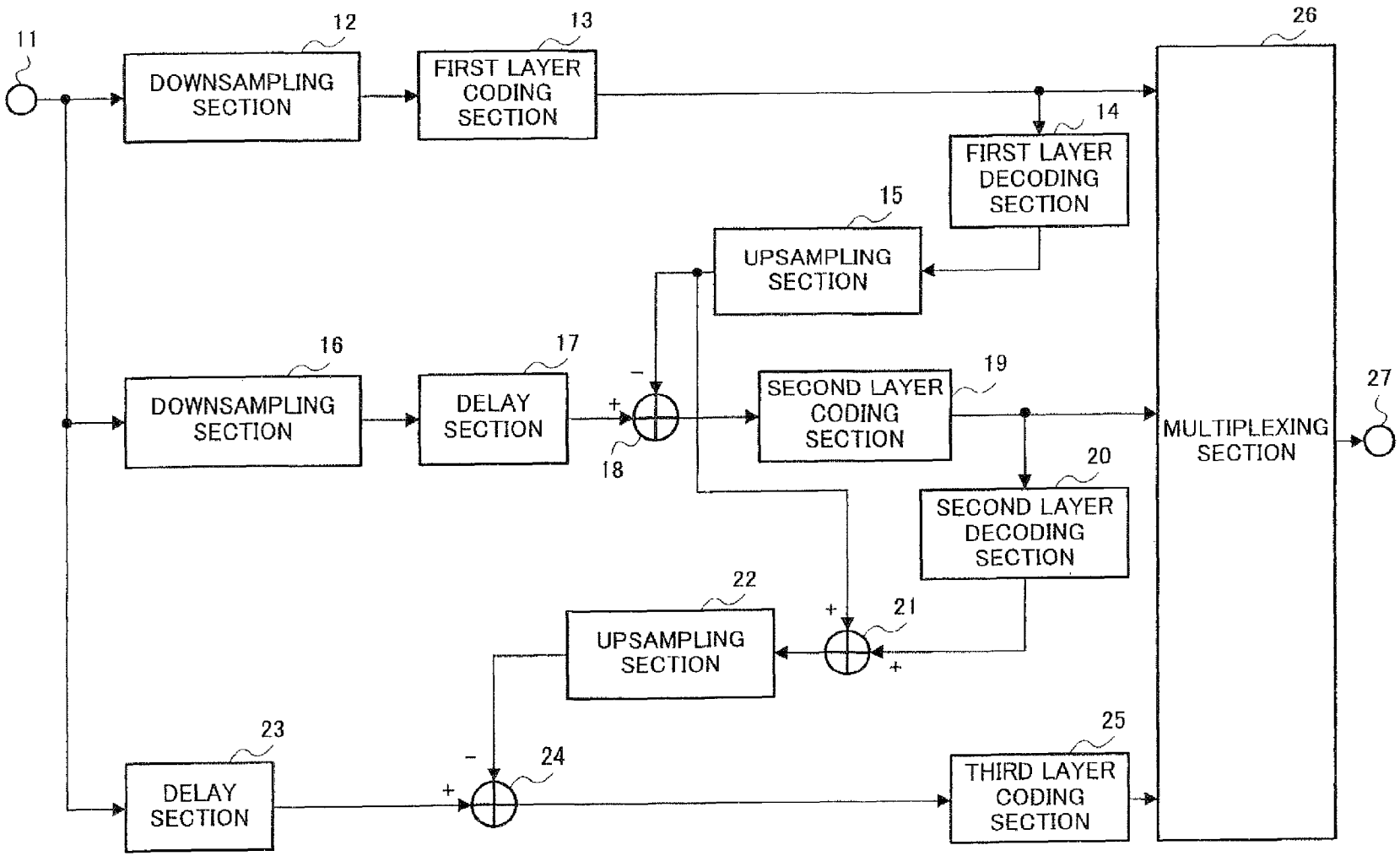
FIG. 1 is a block diagram showing the typical configuration of a coding apparatus that performs scalable coding.
Figure 2:
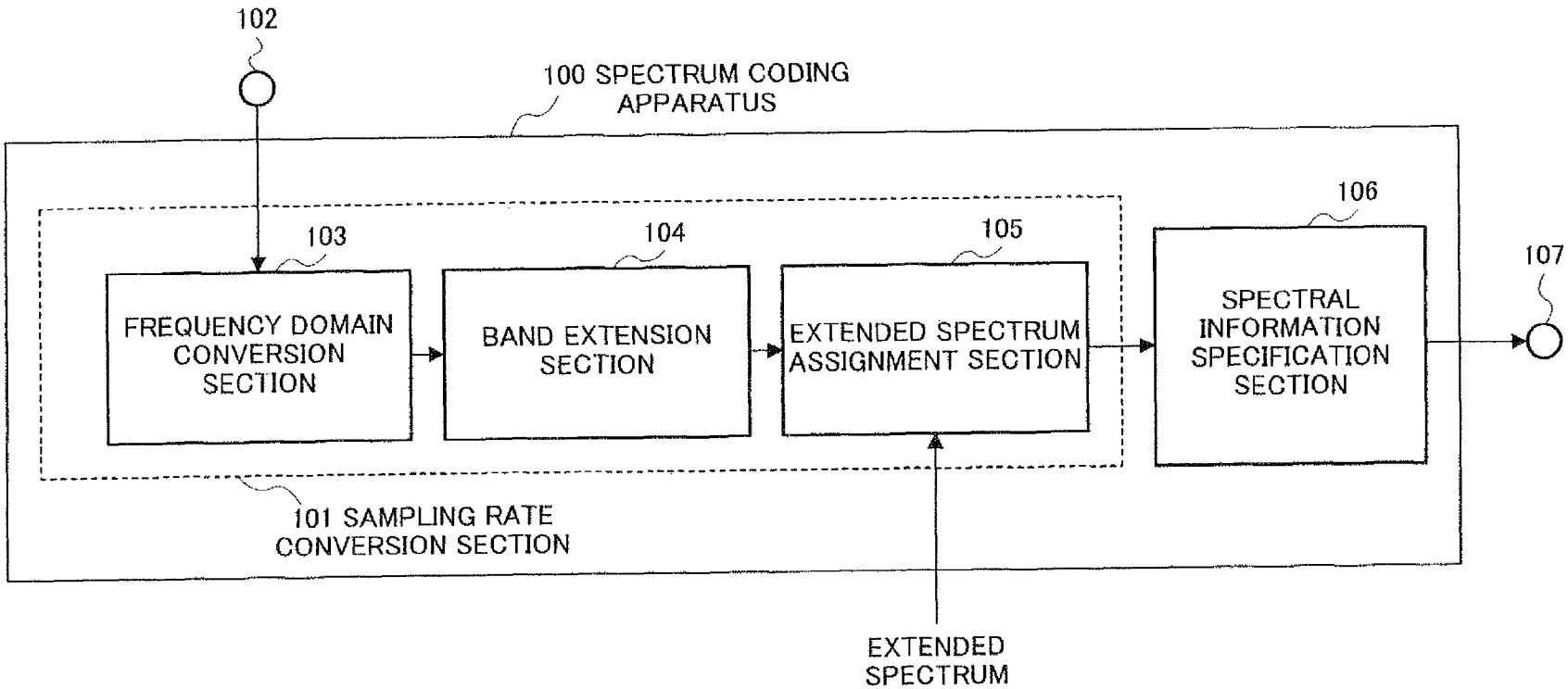
FIG. 2 is a block diagram showing the main configuration of a spectrum coding apparatus according to Embodiment 1.

FIG. 2 is a block diagram showing the main configuration of spectrum coding apparatus 100 according to Embodiment 1 of the present invention.

Spectrum coding apparatus 100 according to this embodiment is provided with sampling rate conversion section 101, input terminal 102, spectral information specification section 106 and output terminal 107. Furthermore, sampling rate conversion section 101 has frequency domain conversion section 103, band extension section 104 and extended spectrum assignment section 105.

A signal sampled at a sampling rate Fx is input to spectrum coding apparatus 100 through input terminal 102.

Frequency domain conversion section 103 converts a time domain signal to a frequency domain signal (frequency domain conversion) by performing a frequency analysis of this signal with an analysis length of 2·Na and calculates first spectrum S1(k)($0 \leqq k < Na$). Then, first spectrum S1(k) calculated is given to band extension section 104. Here, a modified discrete cosine transform (MDCT) is used for the frequency analysis. The MDCT is characterized in that an analysis frame and a successive frame are overlapped by half on top one another and analysis is performed, and thereby distortion between the frames is canceled using an orthogonal basis whereby the first half portion of the analysis frame becomes an odd function and the second half portion of the analysis frame becomes an even function. As the method of the frequency analysis, it is also possible to use a discrete Fourier transform (DFT), discrete cosine transform (DCT) or the like.

Band extension section 104 allocates a new area (frequency band) so that a new spectrum can be assigned to the extended area following to the frequency k=Na of input first spectrum S1(k) and extends the effective frequency band of first spectrum S1(k) to $0 \leqq k < Nb$. The processing of extending this effective frequency band will be explained in detail later.

Extended spectrum assignment section 105 assigns extended spectrum S1'(k)($Na \leqq k < Nb$) input from outside to the frequency band extended by band extension section 104 and outputs it to spectral information specification section 106.

Spectral information specification section 106 outputs information necessary to specify extended spectrum S1'(k) out of the spectrum given from extended spectrum assignment section 105 as the code through output terminal 107. This code is information which shows the subband energy of extended spectrum S1'(k) and information which shows an effective frequency band or the like. Details thereof will also be described later.

Next, details of the processing carried out by above described band extension section 104 to extend the effective frequency band of first spectrum S1(k) will be explained using FIG. 3A and FIG. 3B.

Figures 3A, 3B:
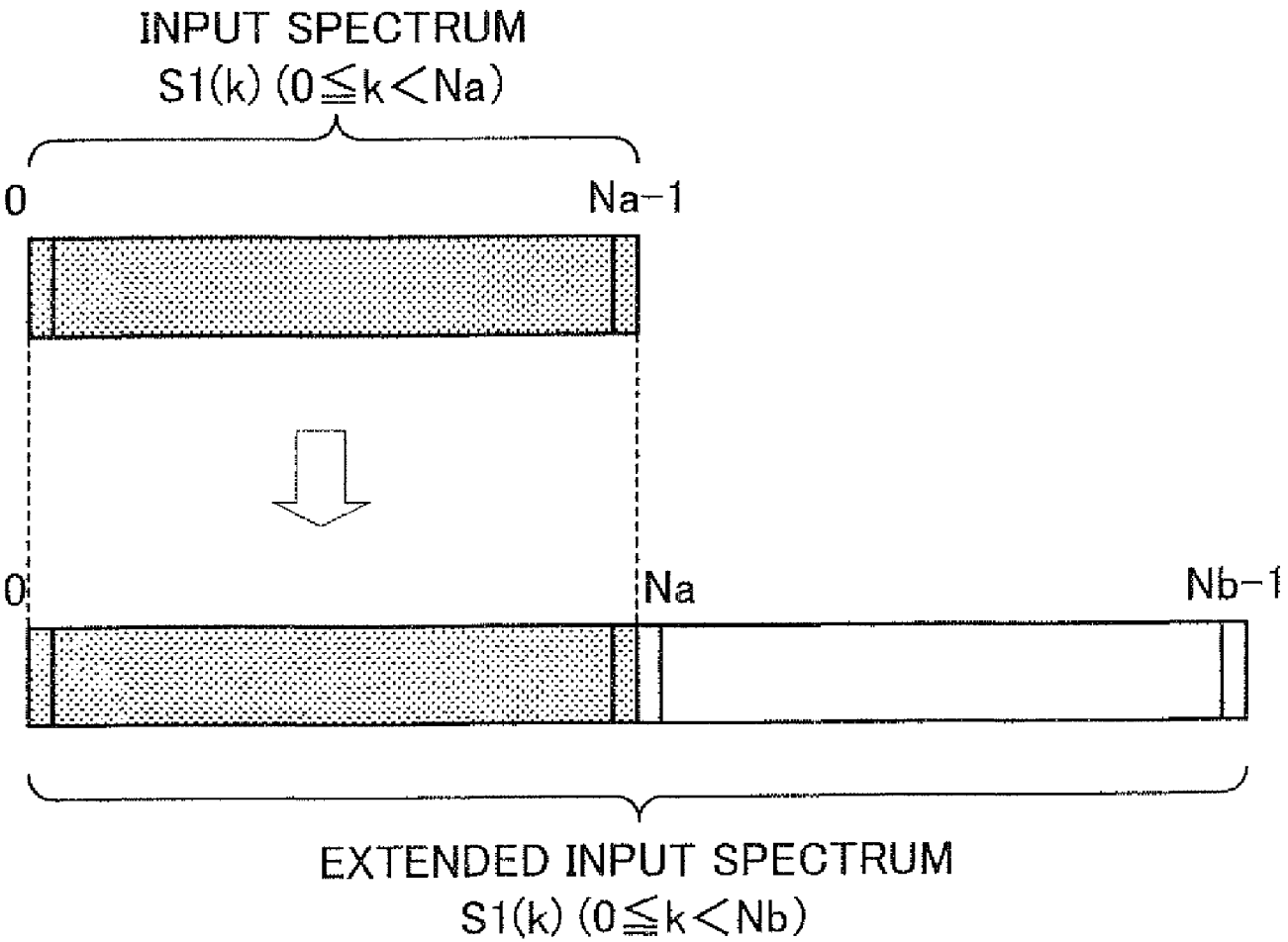
FIG. 3A shows a first spectrum and FIG. 3B shows a spectrum after an effective frequency band is extended.

FIG. 3A shows first spectrum S1(k) given from frequency domain conversion section 103 and FIG. 3B shows spectrum S1(k) after an effective frequency band is extended by band extension section 104. Band extension section 104 allocates the area in which new spectral information can be inserted in the frequency band where frequency k of first spectrum S1(k) is shown in the range of $Na \leqq k < Nb$. The size of this new area is expressed by "Nb-Na".

Here, Nb is determined from the relationship between sampling rate Fx of the signal given from outside through input terminal 102, analysis length 2·Na in frequency domain conversion section 103 and sampling rate Fy of the signal decoded by a decoding section (not shown). More specifically, Nb is set by the following expression:

$$Nb = Na \cdot \frac{Fy}{Fx} \quad \text{(Expression 1)}$$

Furthermore, sampling rate Fy of the signal decoded by the decoding section when Nb has been determined is determined by the following expression:

$$Fy = Fx \cdot \frac{Nb}{Na} \quad \text{(Expression 2)}$$

For example, when the coding section is designed under a condition of Na=128, Fx=16 kHz and a decoded signal of Fy=32 kHz is generated by the decoding section, it is necessary to set Nb=128·32/16=256. Therefore, in this case, an area of 128≦k<256 is allocated. Furthermore, as another example, when the coding section is designed under a condition of Na=128, Nb=384, Fx=8 kHz, the sampling rate of the decoded signal generated by the decoding section becomes Fy=8·384/128=24 kHz.

Figure 4A:
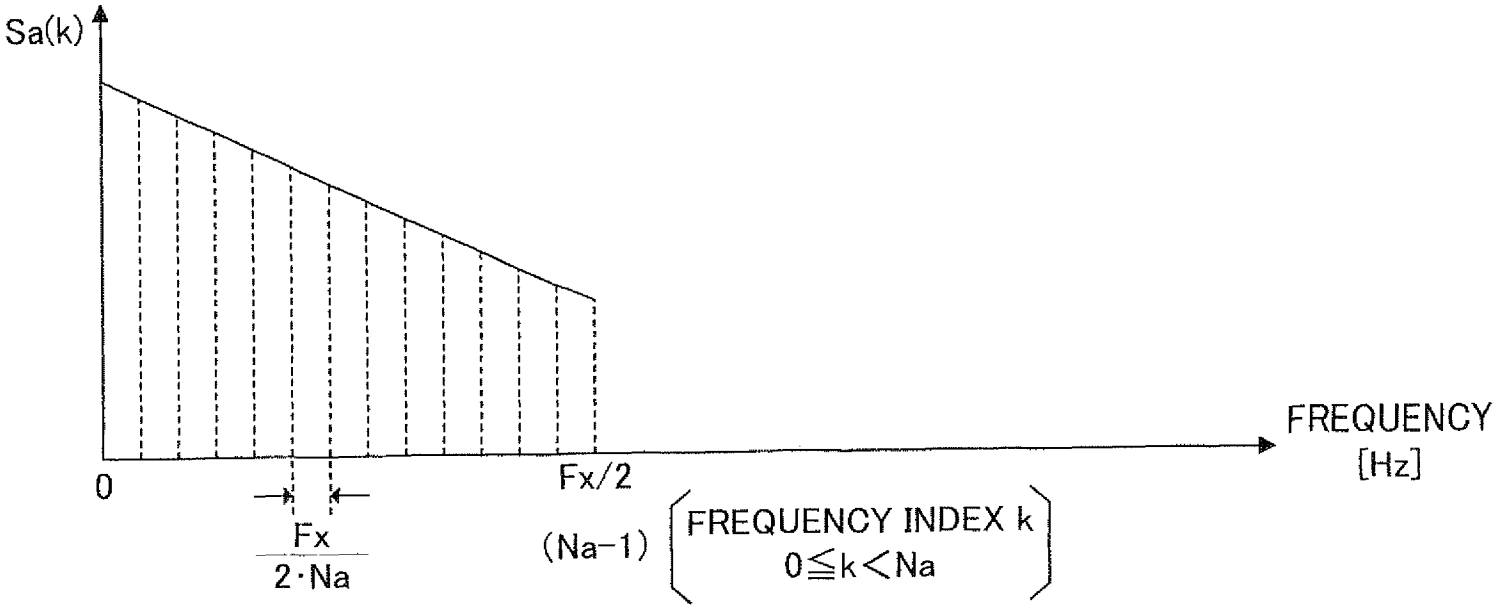
FIG. 4A illustrates the effect of processing of extending an effective frequency band of a spectrum theoretically.
Figure 4B:
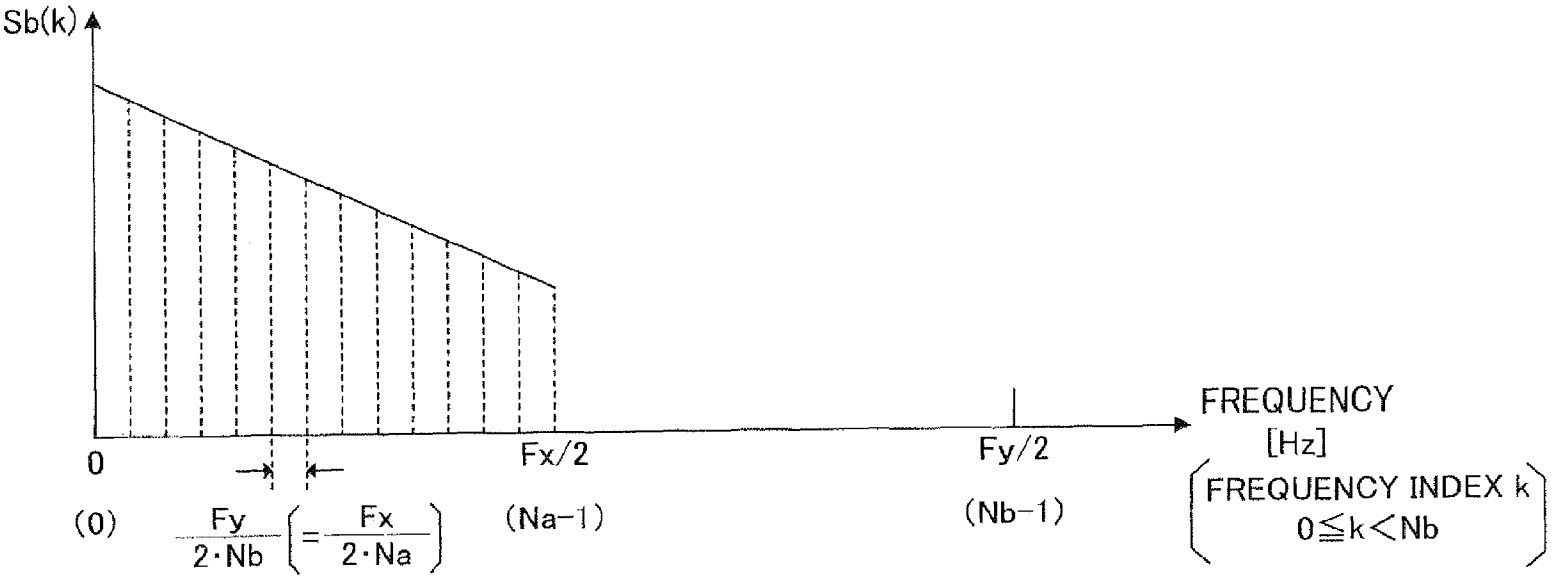
FIG. 4B illustrates the effect of processing of extending an effective frequency band of a spectrum in principle.

FIG. 4A and FIG. 4B illustrate the effect of the processing of extending the effective frequency band of the spectrum carried out by band extension section 104 in principal. FIG. 4A shows the spectrum Sa(k) obtained when performing a frequency analysis of the signal of sampling rate Fx with an analysis length of 2·Na. The horizontal axis shows a frequency and the vertical axis shows spectrum intensity.

The signal effective frequency band is 0 to Fx/2 from the Nyquist theorem. The analysis length is 2·Na at this time, and therefore, the range of frequency index k is 0≦k<Na and the frequency resolution of spectrum Sa(k) is Fx/(2·Na). On the other hand, when spectrum Sb(k) obtained by the frequency analysis with an analysis length of 2·Nb after the same signal is upsampled to sampling rate Fy is shown in FIG. 4B, the signal effective frequency band is extended to 0 to Fy/2 and the range of frequency index k is 0≦k<Nb. Here, when Nb satisfies (Expression 1), frequency resolution Fy/(2·Nb) of spectrum Sb(k) is equal to Fx/(2·Na). That is, spectrum Sa(k) in band 0≦k<Na is equal to spectrum Sb(k). Looking from the opposite point of view, this means that when the band of spectrum Sa(k)(0≦k<Na) is extended to Nb, spectrum Sb(k) matches the spectrum obtained by the frequency analysis with the analysis length of 2·Nb after upsampling the signal of sampling Fx to sampling Fy. Using this principle, it is possible to obtain a spectrum equivalent to the upsampled signal without upsampling in the time domain.

In this way, sampling rate conversion section 101 converts the input time domain signal to a frequency domain signal and extends the effective frequency band of the spectrum obtained, and therefore, it is possible to obtain a spectrum equivalent to the spectrum obtained by converting the frequency of the signal upsampled in the time domain.

Since the signal output from sampling rate conversion section 101 is a signal in the frequency domain, when the signal in the time domain is necessary, it may be possible to provide a time domain conversion section and perform reconversion to the time domain. In above described example, sampling rate conversion section 101 is set inside spectrum coding apparatus 100, and therefore the signal is input to spectral information specification section 106 as the same frequency domain signal without being returned to the time domain signal and a code is generated.

Here, the coding rate of the code output from spectral information specification section 106 changes by adjusting the selection of the extended spectrum input to extended spectrum assignment section 105 and the specific method of the spectral information by spectral information specification section 106. That is, the processing of part in sampling rate conversion section 101 has a large influence on the coding, too. This means that spectrum coding apparatus 100 realizes the conversion of the sampling rate and coding of the input signal at the same time.

Here, for simplicity of explanation, the case where an extended spectrum is assigned to the original spectrum by extended spectrum assignment section 105 has been explained as an example, but the processing carried out by spectral information specification section 106 is intended to output the information necessary to specify an extended spectrum as the code, and it is sufficient that at least the extended spectrum to be assigned is specified, and therefore the extended spectrum need not always be actually assigned.

Furthermore, upsampling has been explained here as an example of the sampling rate conversion but the above described principle can also be applied to downsampling.

Figure 5:
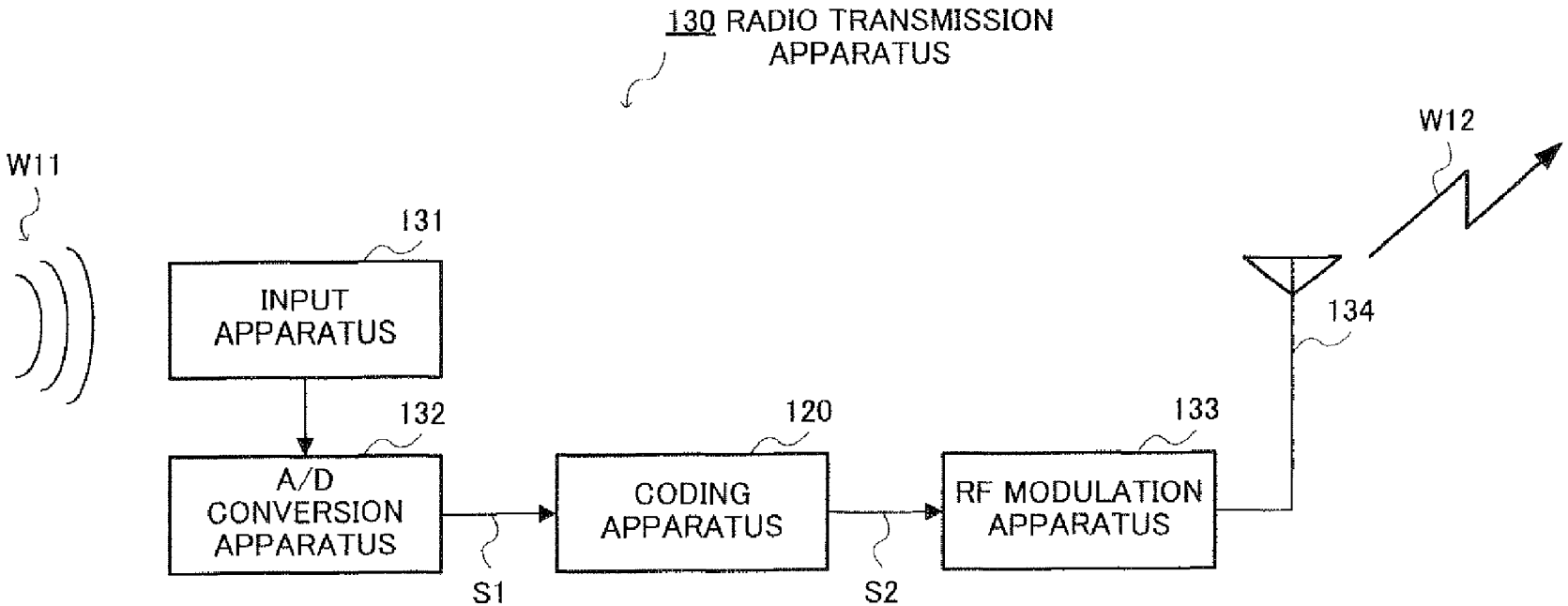
FIG. 5 is a block diagram showing the main configuration of a radio transmission apparatus according to Embodiment 1.

FIG. 5 is a block diagram showing the main configuration of radio transmission apparatus 130 when coding apparatus 120 according to this embodiment is mounted on the transmitting side of the radio communications system.

This radio transmission apparatus 130 includes coding apparatus 120, input apparatus 131, A/D conversion apparatus 132, RF modulation apparatus 133 and antenna 134.

Input apparatus 131 converts sound wave W11 audible to human ears to an analog signal which is an electric signal and outputs it to A/D conversion apparatus 132. A/D conversion apparatus 132 converts this analog signal to a digital signal and outputs it to coding apparatus 120 (signal S1). Coding apparatus 120 encodes input digital signal S1, generates a coded signal and outputs it to RF modulation apparatus 133 (signal S2). RF modulation apparatus 133 modulates coded signal S2, generates a modulated coded signal and outputs it to antenna 134. Antenna 134 transmits the modulated coded signal as radio wave W12.

Figure 6:
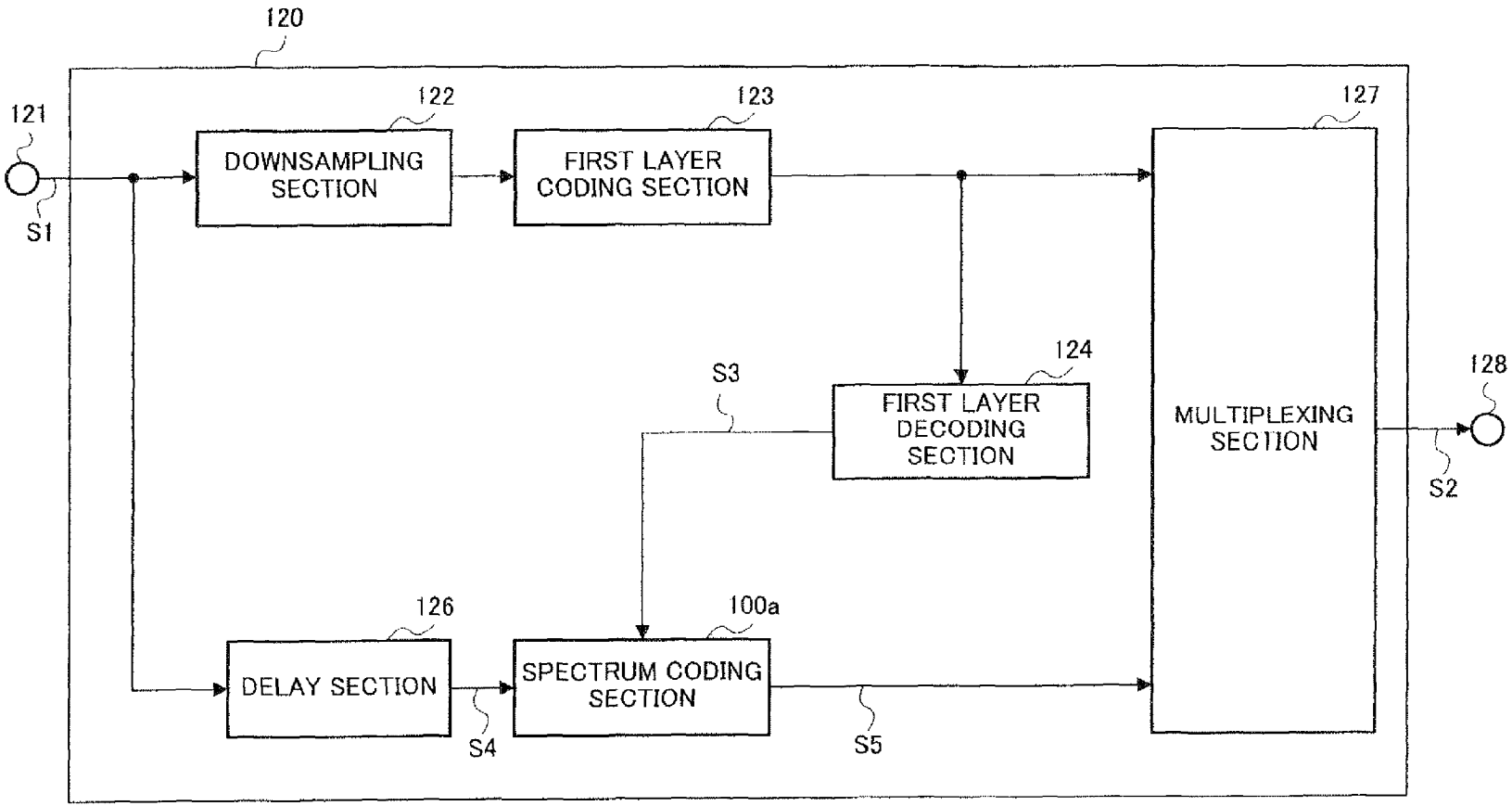
FIG. 6 is a block diagram showing the internal configuration of a coding apparatus according to Embodiment 1.

FIG. 6 is a block diagram showing the internal configuration of above described coding apparatus 120. Here, the case where hierarchical coding (scalable coding) is performed will be explained as an example.

Coding apparatus 120 includes input terminal 121, downsampling section 122, first layer coding section 123, first layer decoding section 124, delay section 126, spectrum coding section 100*a*, multiplexing section 127 and output terminal 128.

Acoustic signal S1 of sampling rate Fy is input to input terminal 121. Downsampling section 122 applies downsampling to signal S1 input through input terminal 121 and generates and outputs a signal having a sampling rate Fx. First layer coding section 123 encodes this downsampled signal and outputs the code obtained to multiplexing section (multiplexer) 127 and also outputs it to first layer decoding section 124. First layer decoding section 124 generates a decoded signal of the first layer based on this code.

On the other hand, delay section 126 gives a delay of a predetermined length to signal S1 input through input terminal 121. Suppose the magnitude of this delay has the same value as a time delay generated when the signal has passed through downsampling section 122, first layer coding section 123 and first layer decoding section 124. Spectrum coding section 100*a* performs spectrum coding using signal S3 having a sampling rate Fx output from first layer decoding section 124 and signal S4 having a sampling rate Fy output from delay section 126 and outputs generated code S5 to multiplexing section 127. Multiplexing section 127 multiplexes the code obtained by first layer coding section 123 with code S5 obtained by spectrum coding section 100*a* and outputs the multiplexed signal as output code S2 through output terminal 128. This output code S2 is given to RF modulation apparatus 133.

Figure 7:
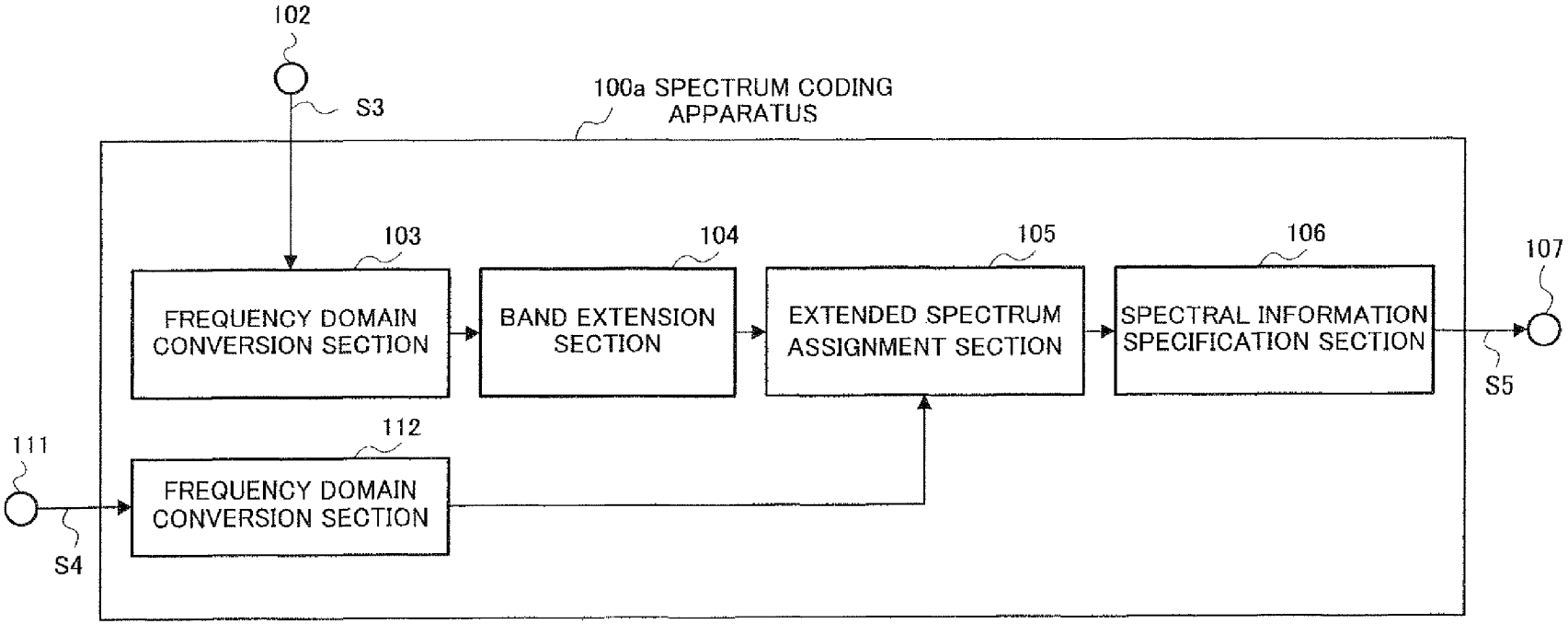
FIG. 7 is a block diagram showing the internal configuration of a spectrum coding section according to Embodiment 1.

FIG. 7 is a block diagram showing the internal configuration of above described spectrum coding section 100*a*. This spectrum coding section 100*a* has a basic configuration similar to that of spectrum coding apparatus 100 shown in FIG. 2, and therefore the same components are assigned the same reference numerals and explanations thereof will be omitted.

A feature of spectrum coding section 100*a* is to give extended spectrum S1'(k)(Na≦k<Nb) using the spectrum of input signal S3 having sampling rate Fy. According to this, since a target signal to determine extended spectrum S1'(k) is given, and therefore the accuracy of extended spectrum S1'(k) improves and as a result, the effect of leading to quality improvement is obtained.

Frequency domain conversion section 112 performs a frequency analysis of signal S4 of the sampling rate Fy input through input terminal 111 with analysis length 2·Nb and obtains second spectrum S2(k)(0≦k<Nb). Here, suppose that the relationship shown in (Expression 1) holds between sampling frequencies Fx, Fy and analysis lengths Na, Nb.

Spectral information specification section 106 determines the code which shows extended spectrum S1'(k). Here, extended spectrum S1'(k) is determined using second spectrum S2(k) obtained by frequency domain conversion section 112. Spectral information specification section 106 determines a code in two steps; a step of determining the shape of extended spectrum S1'(k) and a step of determining the gain of extended spectrum S1'(k).

The step of determining the shape of extended spectrum S1'(k) will be explained below first.

In this step, extended spectrum S1'(k) is determined using the band 0≦k<Na of first spectrum S1(k). As the specific method thereof, first spectrum S1(k) which is separated by a certain fixed value C on the frequency axis as shown in the following expression is copied to extended spectrum S1'(k).

$$S1'(k)=S1(k-C)(Na\leqq k<Nb) \quad \text{(Expression 3)}$$

Here, C is a predetermined fixed value and needs to satisfy the condition of C≦Na. According to this method, the information indicating the shape of extended spectrum S1'(k) is not output as the code.

As another method, instead of above described fixed value C, it may be also possible to use variable T which takes a value in a certain predetermined range $T_{MIN}$ to $T_{MAX}$ and output value T' of variable T when the shape of extended spectrum S1'(k) is most similar to that of second spectrum S2(k) as part of the code. At this time, extended spectrum S1'(k) is shown by the following expression:

$$S1'(k)=S1(k-T')(Na\leqq k<Nb) \quad \text{(Expression 4)}$$

Next, the step of determining the gain of extended spectrum S1'(k) obtained by spectrum information specification section 106 will be explained below.

The gain of extended spectrum S1'(k) is determined so as to match the power in the band Na≦k<Nb of second spectrum S2(k). More specifically, according to the following expression, deviation V of the power is calculated, and an index obtained by quantizing this value is output as the code through output terminal 107.

$$V=\sqrt{\frac{\sum_{k=Na}^{Nb-1} S2(k)^2}{\sum_{k=Na}^{Nb-1} S1'(k)^2}} \quad \text{(Expression 5)}$$

Furthermore, it may be also possible to adopt a mode in which extended spectrum S1'(k) is divided into a plurality of subbands and determine a code independently for each subband. In such a case, in the step of determining the shape of extended spectrum S1'(k), it is possible to determine T' expressed by (Expression 4) for each subband and output it as the code and determine only one common T' and output it as the code. Then, in the step of determining the gain of extended spectrum S1'(k), deviation V(j) of the power is calculated for each subband and an index obtained by quantizing this value is output as the code through output terminal 107. The amount of variation of the power for each subband is expressed by the following expression:

$$V(j)=\sqrt{\frac{\sum_{k=BL(j)}^{BH(j)} S2(k)^2}{\sum_{k=BL(j)}^{BH(j)} S1'(k)^2}} \quad \text{(Expression 6)}$$

where, j denotes a subband number and BL(j) denotes a frequency index corresponding to the minimum frequency of the jth subband, BH(j) denotes a frequency index corresponding to the maximum frequency of the jth subband. By adopting the configuration in which a code is output for each subband in this way, it is possible to realize the scalable function.

Figure 8:
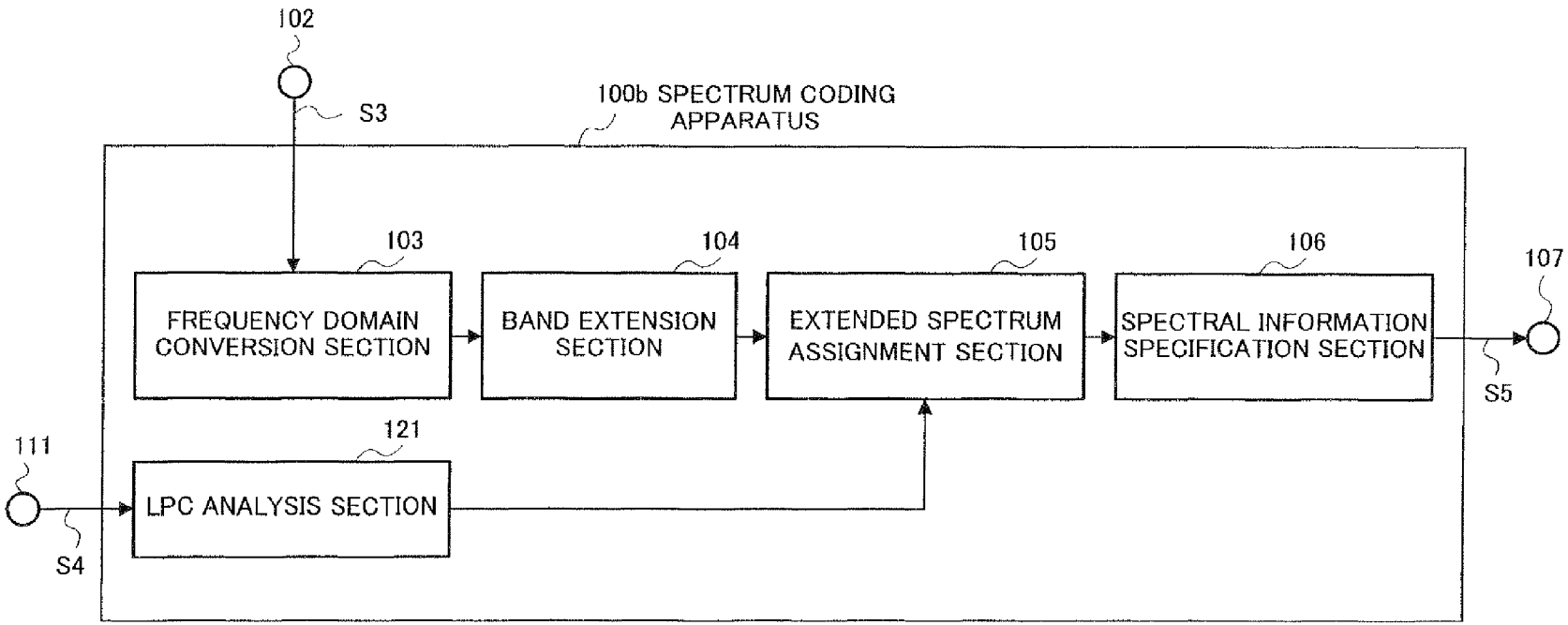
FIG. 8 is a block diagram showing a variation of the spectrum coding section according to Embodiment 1.

Apart from the mode in which second spectrum S2(k) is calculated as shown in FIG. 7, it is also possible to adopt a mode (spectrum coding section 100*b*) in which the signal of sampling rate Fy is LPC-analyzed as shown in FIG. 8. That is, it is also possible to LPC-analyze the signal of sampling rate Fy, obtain an LPC coefficient and determine extended spectrum S1'(k) using this LPC coefficient. In this configuration, it is possible to apply a DFT to the LPC coefficient and convert it to spectral information and determine extended spectrum S1'(k) using this spectrum.

In this way, according to the coding apparatus of this Embodiment, it is possible to reduce the circuit scale of the coding apparatus and also reduce the amount of coding processing calculation.

In addition to the above described effect, the following effect is obtained when the coding apparatus of this Embodiment is applied to scalable coding.

As in the case of the conventional art, when the sampling rate is converted in the time domain, the input signal needs to be passed through a low pass filter (hereinafter referred to as "LPF") to avoid aliasing. Generally, when filtering processing is performed in the time domain, a time delay occurs in the output signal with respect to the input signal. When an FIR-type filter is applied to the LPF, the filter order must be increased to make its cutoff characteristic steep, which produces not only a substantial increase of the amount of calculation but also a time delay equivalent to the half of sample numbers of the filter order.

For example, when a 256th-order filter is applied to a signal having a sampling frequency Fs=24 kHz, a delay equal to or greater than 5 ms is produced by only a sampling rate conversion. The occurrence of such a delay, when the 256th-order filter is applied to a bidirectional speech communication, causes a problem because the reaction of the other side of communication is perceived as if it becomes slower.

Furthermore, when using an IIR-type filter for the LPF, the cutoff characteristic can be made steeper even if the order is reduced comparatively and the delay never becomes as big as that of the FIR-type filter. However, in the case of using the IIR-type filter, it is not possible to design such a filter that the amount of delay which occurs in all the frequencies like the FIR-type filter becomes constant. In scalable coding, when a signal after the sampling rate conversion is subtracted from the input signal during the scalable coding, it is necessary to give a predetermined delay amount to the input signal according to the time delay of the signal after the sampling rate conversion. However, when an IIR-type LPF is used, the amount of delay with respect to the frequency is not constant, and therefore the problem that the subtraction processing cannot be performed accurately occurs.

The coding apparatus of this embodiment can solve these problems which occur during scalable coding.

Figure 9:
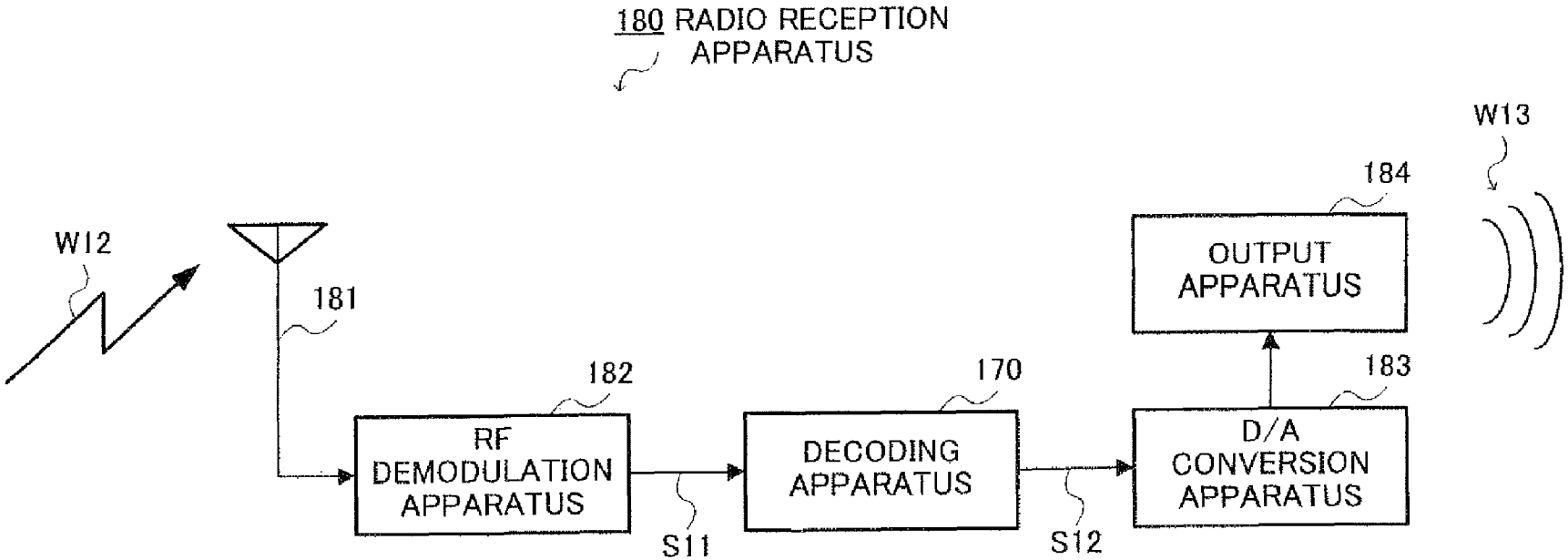
FIG. 9 is a block diagram showing the main configuration of a radio reception apparatus according to Embodiment 1.

FIG. 9 is a block diagram showing the main configuration of radio reception apparatus 180 which receives a signal transmitted from radio transmission apparatus 130.

This radio reception apparatus 180 is provided with antenna 181, RF demodulation apparatus 182, decoding apparatus 170, D/A conversion apparatus 183 and output apparatus 184.

Antenna 181 receives a digital coded acoustic signal as radio wave W12, generates a digital received coded acoustic signal which is an electric signal and gives it to RF demodulation apparatus 182. RF demodulation apparatus 182 demodulates the received coded acoustic signal from antenna 181, generates a demodulated coded acoustic signal S11 and gives it to decoding apparatus 170.

Decoding apparatus 170 receives digital demodulated coded acoustic signal S11 from RF demodulation apparatus 182, performs decoding processing, generates digital decoded acoustic signal S12 and gives it to D/A conversion apparatus 183. D/A conversion apparatus 183 converts digital decoded acoustic signal S12 from decoding apparatus 170, generates an analog decoded voice signal and gives it to output apparatus 184. Output apparatus 184 converts the analog decoded voice signal which is an electric signal to vibration of the air and outputs it as sound wave W13 audible to human ears.

Figure 10:
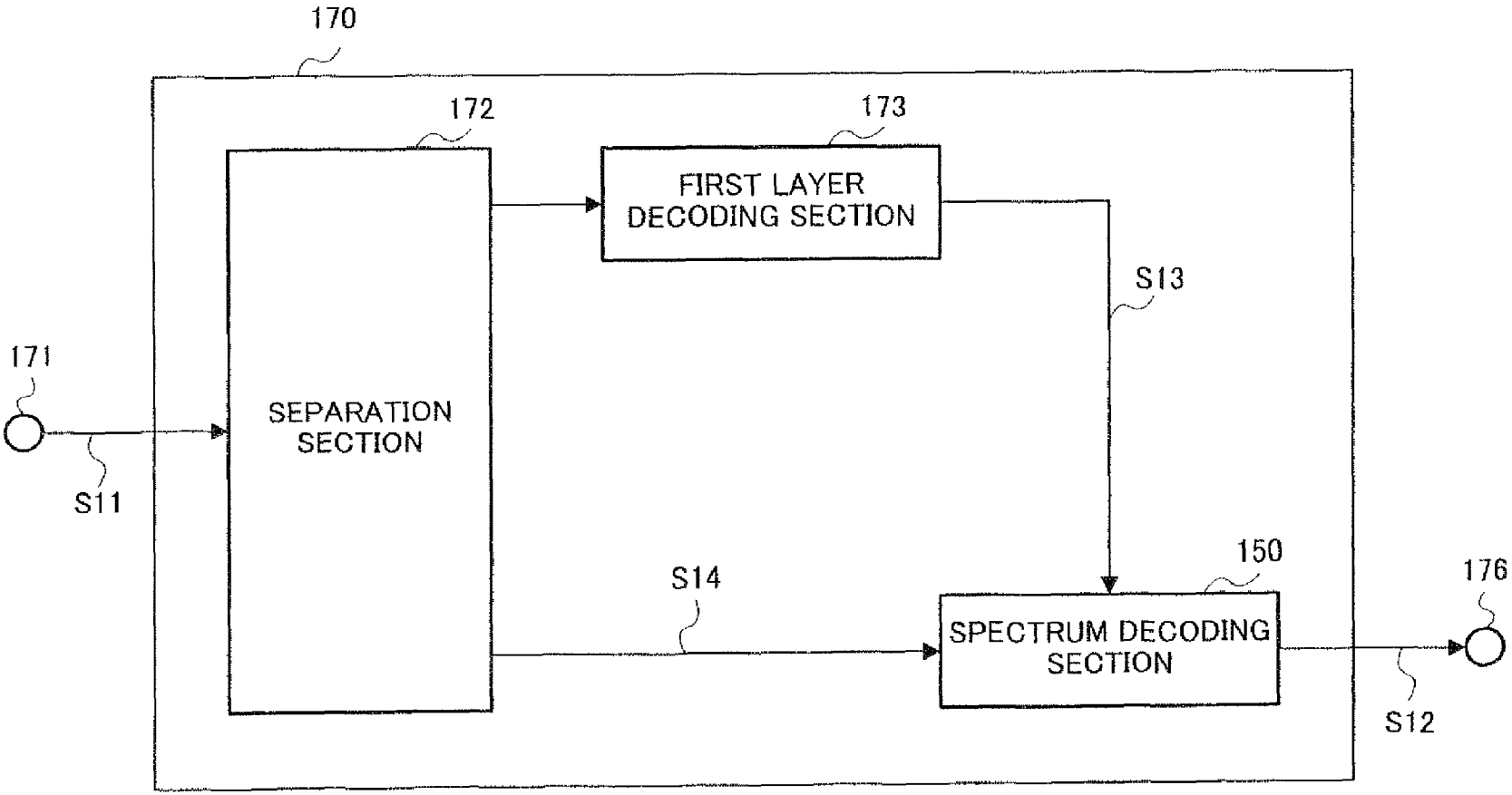
FIG. 10 is a block diagram showing the internal configuration of a decoding apparatus according to Embodiment 1.

FIG. 10 is a block diagram showing the internal configuration of above described decoding apparatus 170. Also here, a case where a signal generated by hierarchical coding is decoded will be explained as an example.

This decoding apparatus 170 is provided with input terminal 171, separation section 172, first layer decoding section 173, spectrum decoding section 150 and output terminal 176.

Code S11 generated by hierarchical coding is input from RF demodulation apparatus 182 to input terminal 171. Separation section 172 separates demodulated coded acoustic signal S11 input through input terminal 171 and generates a code for first layer decoding section 173 and a code for spectrum decoding section 150. First layer decoding section 173 decodes the decoded signal of sampling rate Fx using the code obtained from separation section 172 and gives this decoded signal S13 to spectrum decoding section 150. Spectrum decoding section 150 performs spectrum decoding which will be described later on code S14 separated by separation section 172 and signal S13 of sampling rate Fx generated by first layer decoding section 173, generates decoded signal S12 of sampling rate Fy and outputs this through output terminal 176.

Figure 11:
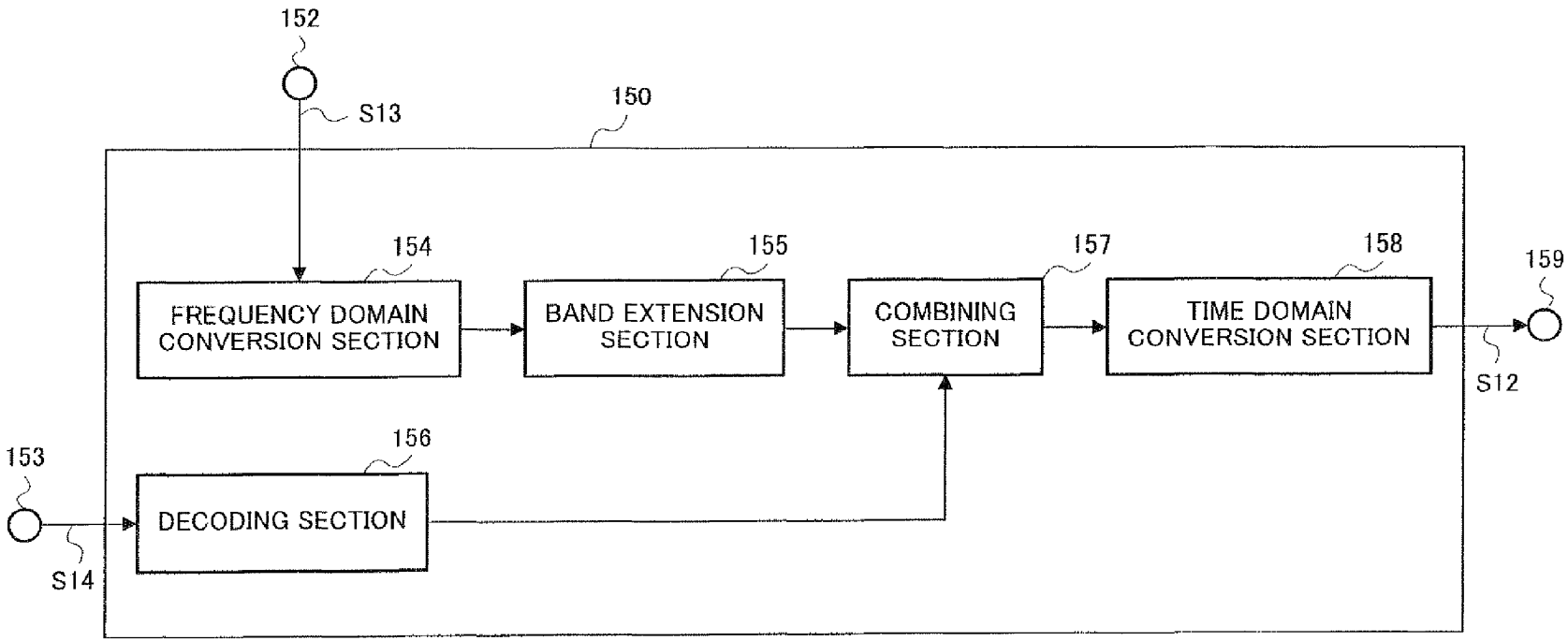
FIG. 11 is a block diagram showing the internal configuration of a spectrum decoding section according to Embodiment 1.

FIG. 11 is a block diagram showing the internal configuration of above described spectrum decoding section 150.

This spectrum decoding section 150 includes input terminals 152, 153, frequency domain conversion section 154, band extension section 155, decoding section 156, combining section 157, time domain conversion section 158 and output terminal 159.

Signal S13 sampled at sampling rate Fx is input to input terminal 152. Furthermore, code S14 related to extended spectrum S1'(k) is input to input terminal 153.

Frequency domain conversion section 154 performs a frequency analysis of time domain signal S13 input from input terminal 152 with an analysis length of 2·Na and calculates first spectrum S1(k). A modified discrete cosine transform (MDCT) is used as the frequency analysis method. The MDCT is characterized in that an analysis frame and a successive frame are overlapped by half on top one another and analysis is performed, and thereby distortion between the frames is canceled using an orthogonal basis whereby the first half portion of the analysis frame becomes an odd function and the second half portion of the analysis frame becomes an even function. First spectrum S1(k) obtained in this way is given to band extension section 155. As the frequency analysis method, a discrete Fourier transform (DFT), discrete cosine transform (DCT) or the like can also be used.

Band extension section 155 allocates an area so that a new spectrum can be assigned to the extended area following to the frequency k=Na of input first spectrum S1(k) and ensures that the band of first spectrum S1(k) become $0 \leqq k < Nb$. First spectrum S1(k) whose band has been extended is output to combining section 157.

On the other hand, decoding section 156 decodes code S14 related to extended spectrum S1'(k) input through input terminal 153, obtains extended spectrum S1'(k) and outputs it to combining section 157.

Combining section 157 combines first spectrum S1(k) given from band extension section 155 and extended spectrum S1'(k). This combination is realized by inserting extended spectrum S1'(k) in the band $Na \leqq k < Nb$ of first spectrum S1(k). First spectrum S1(k) obtained through this processing is output to time domain conversion section 158.

Time domain conversion section 158 applies time domain conversion processing which is equivalent to the inverse conversion of the frequency domain conversion carried out by spectrum coding section 100*a* and generates signal S12 in the time domain through a multiplication of an appropriate window function and a overlap-add processing. Signal S12 in the time domain generated in this way is output as the decoded signal through output terminal 159.

Next, the processing to be carried out by band extension section 155 will be explained using FIG. 12A and FIG. 12B.

Figures 12A, 12B:
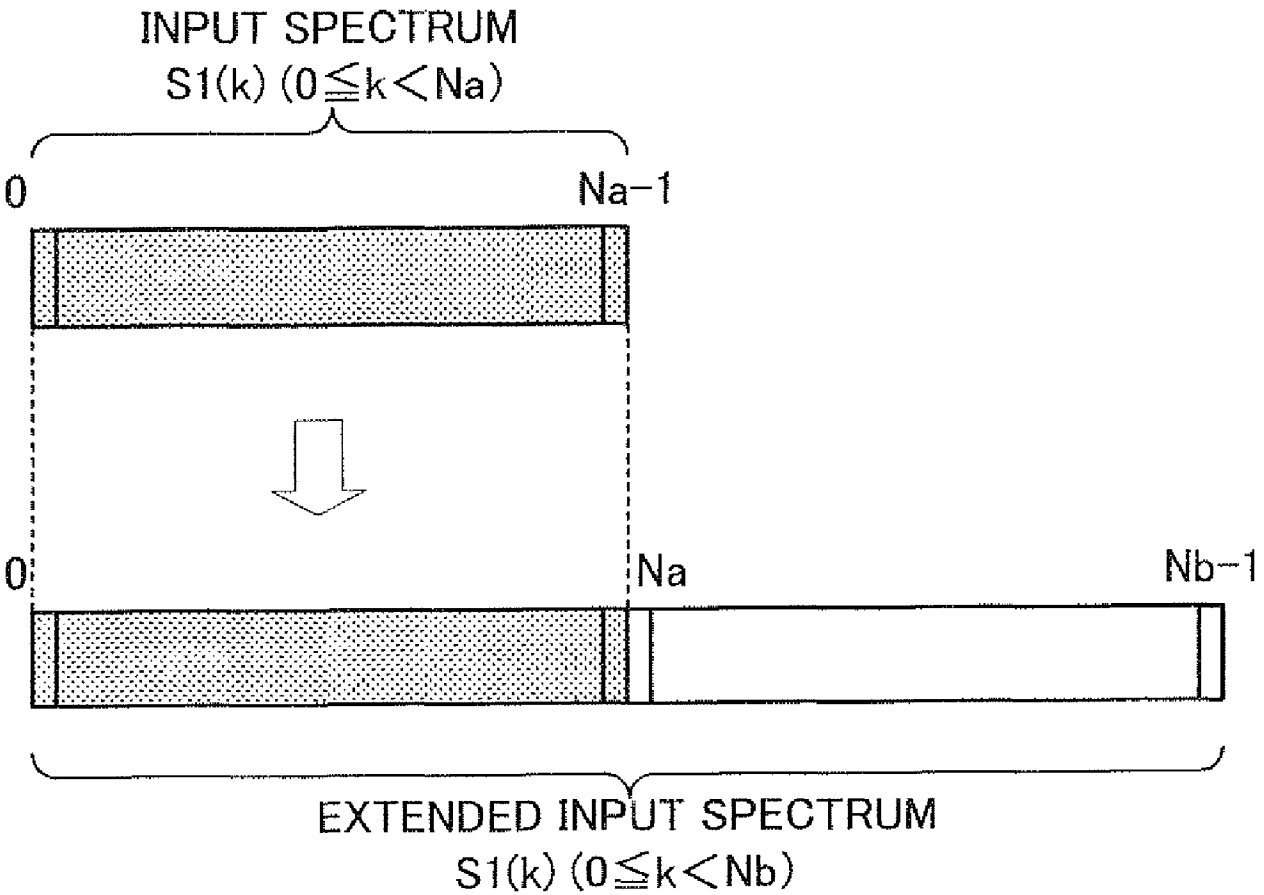
FIG. 12A and FIG. 12B illustrate the processing carried out by a band extension section according to Embodiment 1.

FIG. 12A shows first spectrum S1(k) given from frequency domain conversion section 154. FIG. 12B shows the spectrum obtained as a result of the processing of band extension section 155 and an area in which new spectral information can be stored is allocated in the band in which frequency k is expressed in the range of $Na \leqq k < Nb$. The size of this new area is expressed by Nb-Na. Nb depends on the relationship among sampling rate Fx of the signal given from input terminal 152, analysis length 2·Na of frequency domain conversion section 154 and sampling rate Fy of the signal decoded by spectrum decoding section 150, and it is possible to set Nb according to the following expression:

$$Nb = Na \cdot \frac{Fy}{Fx} \quad \text{(Expression 7)}$$

Also, when Nb is determined, sampling rate Fy of the signal decoded by spectrum decoding section 150 is determined by the following expression:

$$Fy = Fx \cdot \frac{Nb}{Na} \quad \text{(Expression 8)}$$

For example, when a decoded signal having a sampling rate of Fy=32 kHz is generated by spectrum decoding section 150 under the condition where the sampling rate of the input signal is Fx=16 kHz and the analysis length of frequency domain conversion section 154 is Na=128, it is necessary to set Nb=128·32/16=256 at band extension section 155. Therefore, in this case, band extension section 155 allocates the area of 128≦k<256. In another example, when the sampling rate of the input signal is Fx=8 kHz, the analysis length of frequency domain conversion section 154 is Na=128 and the amount of extension of band extension section 155 is Nb=384, the sampling rate of the decoded signal generated at spectrum decoding section 150 is Fy=8·384/128=24 kHz.

Figure 13:
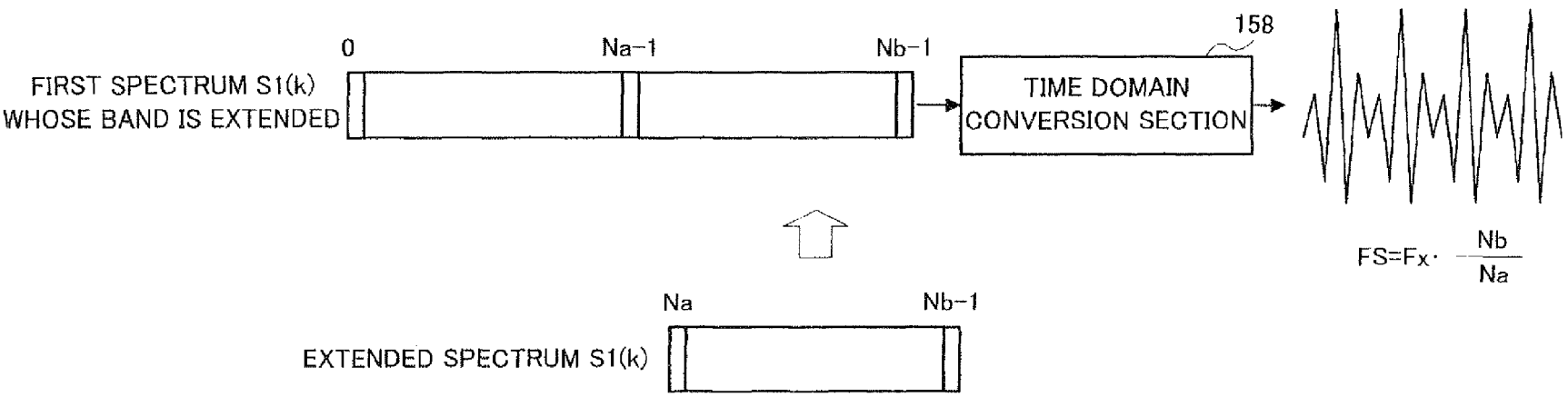
FIG. 13 illustrates how a spectrum is processed at a combining section and a time domain conversion section according to Embodiment 1 to generate a decoded signal.

FIG. 13 shows how a decoded signal is generated through the processing of combining section 157 and time domain conversion section 158.

Combining section 157 inserts extended spectrum S1'(k) (Na≦k<Nb) in the band of Na≦k<Nb of first spectrum S1(k) where a band has been extended and sends combined first spectrum S1(k)(0≦k<Nb) obtained by insertion to time domain conversion section 158. Time domain conversion section 158 generates a decoded signal in the time domain and this allows a decoded signal having a sampling rate of FS (=Fx·Nb/Na).

In this way, the decoding apparatus according to this embodiment can decode a signal coded by the coding apparatus according to this embodiment.

Here, the case where the coding apparatus or the decoding apparatus according to this embodiment is applied to a radio communications system has been explained as an example, but the coding apparatus or the decoding apparatus according to this embodiment can also be applied to a wired communications system as shown below.

Figure 14A:
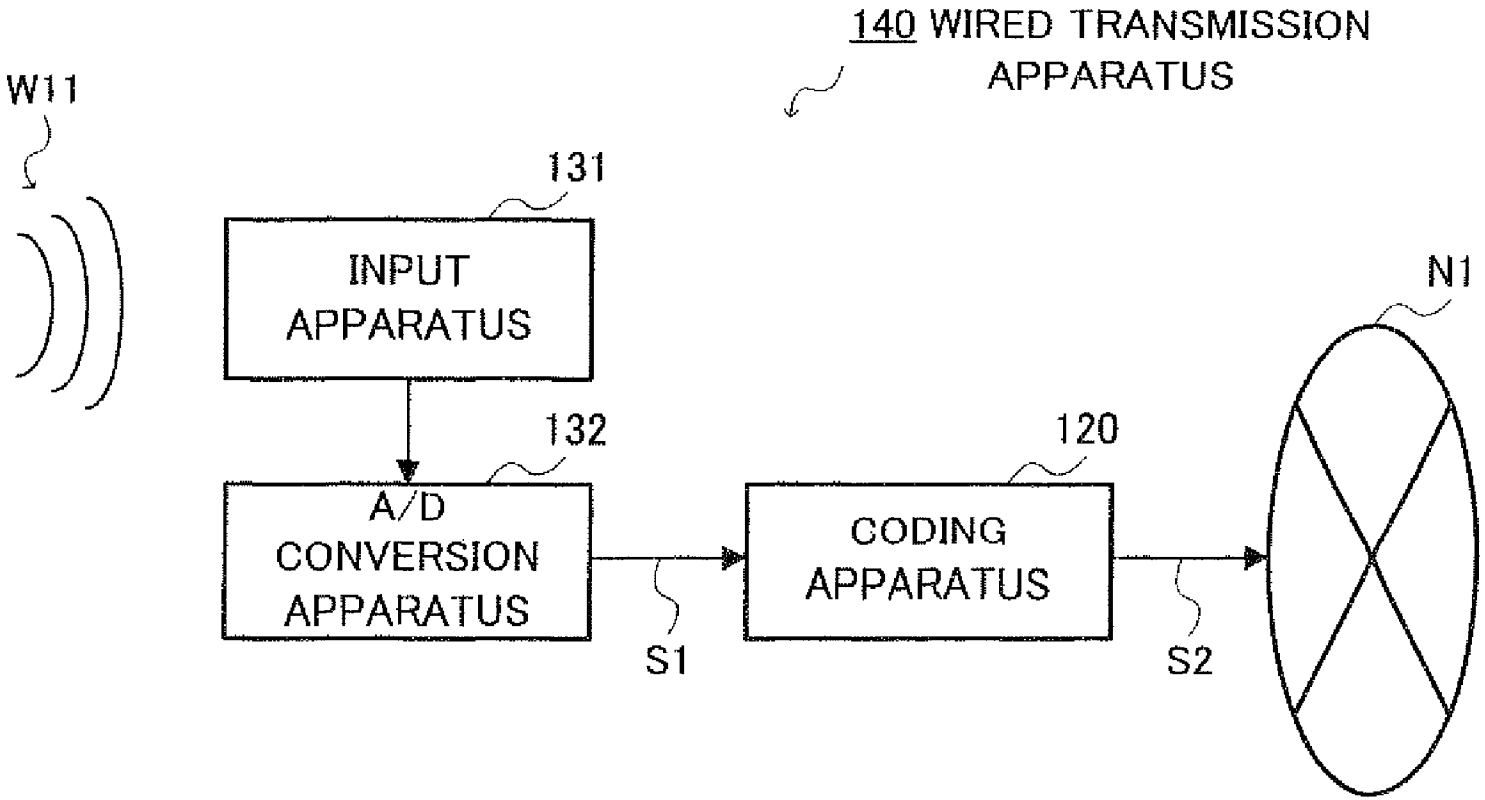
FIG. 14A is a block diagram showing the main configuration on the transmitting side when the coding apparatus according to Embodiment 1 is applied to a wired communications system.

FIG. 14A is a block diagram showing the main configuration of the transmitting side when the coding apparatus according to this embodiment is applied to a wired communications system. The same components as those shown in FIG. 5 are assigned the same reference numerals and explanations thereof will be omitted.

Wired transmission apparatus 140 includes coding apparatus 120, input apparatus 131 and A/D conversion apparatus 132 and the output thereof is connected to network N1.

The input terminal of A/D conversion apparatus 132 is connected to the output terminal of input apparatus 131. The input terminal of coding apparatus 120 is connected to the output terminal of A/D conversion apparatus 132. The output terminal of coding apparatus 120 is connected to network N1.

Input apparatus 131 converts sound wave W11 audible to human ears to an analog signal which is an electric signal and gives it to A/D conversion apparatus 132. A/D conversion apparatus 132 converts an analog signal to a digital signal and gives it to coding apparatus 120. Coding apparatus 120 encodes an input digital signal, generates a code and outputs it to network N1.

Figure 14B:
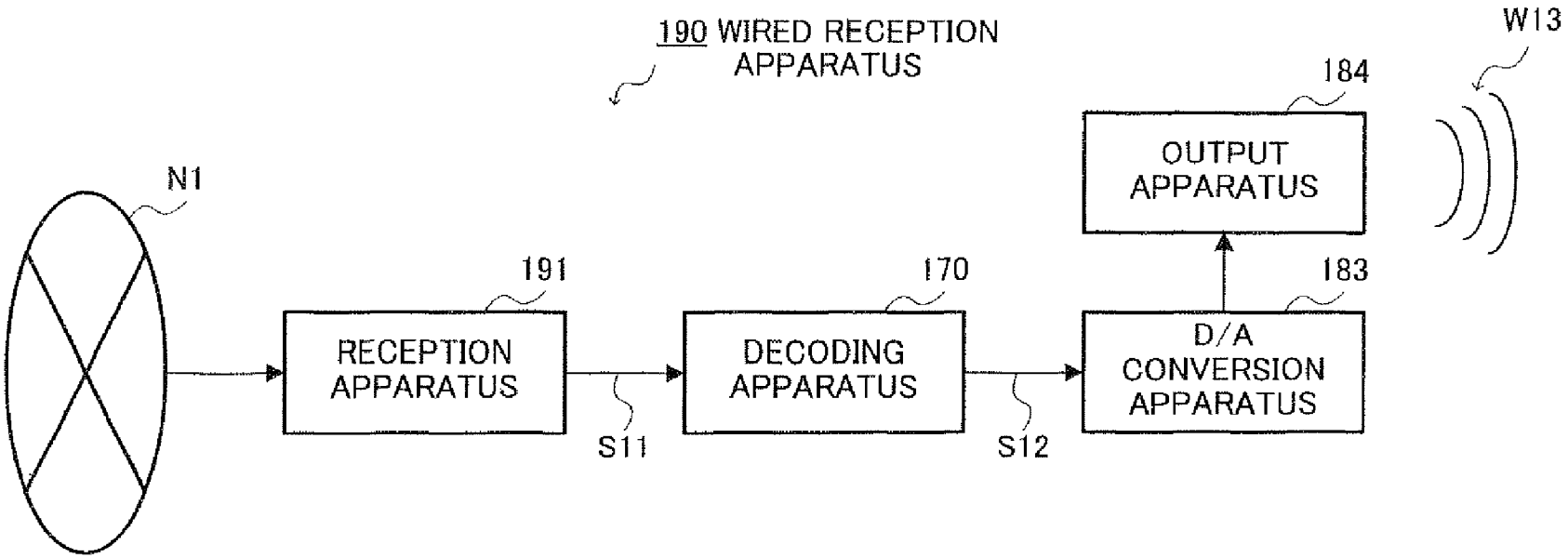
FIG. 14B is a block diagram showing the main configuration on the receiving side when the decoding apparatus according to Embodiment 1 is applied to a wired communications system.

FIG. 14B is a block diagram showing the main configuration of the receiving side when the decoding apparatus according to this embodiment is applied to a wired communications system. The same components as those shown in FIG. 9 are assigned the same reference numerals and explanations thereof will be omitted.

Wired reception apparatus 190 includes reception apparatus 191 connected to network N1, decoding apparatus 170, D/A conversion apparatus 183 and output apparatus 184.

The input terminal of reception apparatus 191 is connected to network N1. The input terminal of decoding apparatus 170 is connected to the output terminal of reception apparatus 191. The input terminal of D/A conversion apparatus 183 is connected to the output terminal of decoding apparatus 170. The input terminal of output apparatus 184 is connected to the output terminal of D/A conversion apparatus 183.

Reception apparatus 191 receives a digital coded acoustic signal from network N1, generates a digital received acoustic signal and gives it to decoding apparatus 170. Decoding apparatus 170 receives the received acoustic signal from reception apparatus 191, carries out decoding processing on this received acoustic signal, generates a digital decoded acoustic signal and gives it to D/A conversion apparatus 183. D/A conversion apparatus 183 converts the digital decoded voice signal from decoding apparatus 170, generates an analog decoded voice signal and gives it to output apparatus 184. Output apparatus 184 converts the analog decoded acoustic signal which is an electric signal to vibration of the air and outputs it as sound wave W13 audible to human ears.

In this way, according to the above described configuration, it is possible to provide a wired transmission/reception apparatus having operations and effects similar to those of the above described transmission/reception apparatus.

(Embodiment 2)

Figure 15:
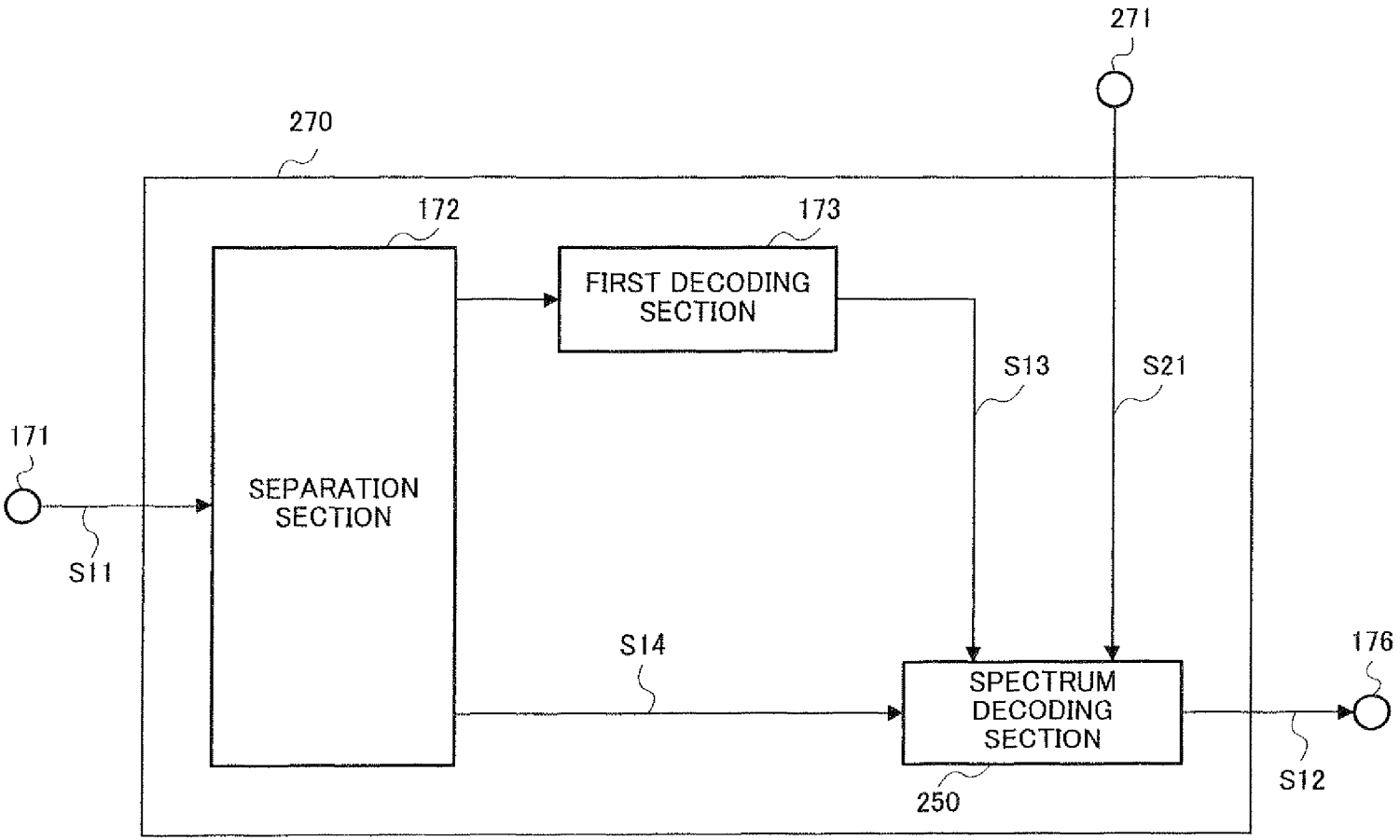
FIG. 15 is a block diagram showing the main configuration of a decoding apparatus according to Embodiment 2.

FIG. 15 is a block diagram showing the main configuration of decoding apparatus 270 according to Embodiment 2 of the present invention. This decoding apparatus 270 has a basic configuration similar to that of decoding apparatus 170 shown in FIG. 10, and therefore the same components are assigned the same reference numerals and explanations thereof will be omitted.

A feature of this embodiment is to generate a decoded signal having a desired sampling rate by correcting maximum frequency index Nb of first spectrum S1(k)(0≦k<Nb) after combination processing to desired value Nc.

Spectrum decoding section 250 carries out spectrum decoding using code S14 separated by separation section 172, signal S13 of sampling rate Fx generated by first layer decoding section 173 and coefficient Nc (signal S21) input through input terminal 271. Spectrum decoding section 250 then outputs the decoded signal of sampling rate Fy obtained through output terminal 176. When the analysis length of frequency domain conversion of spectrum decoding section 250 is 2·Na, sampling rate Fy of the decoded signal is expressed Fy=Fx·Nc/Na.

Figure 16:
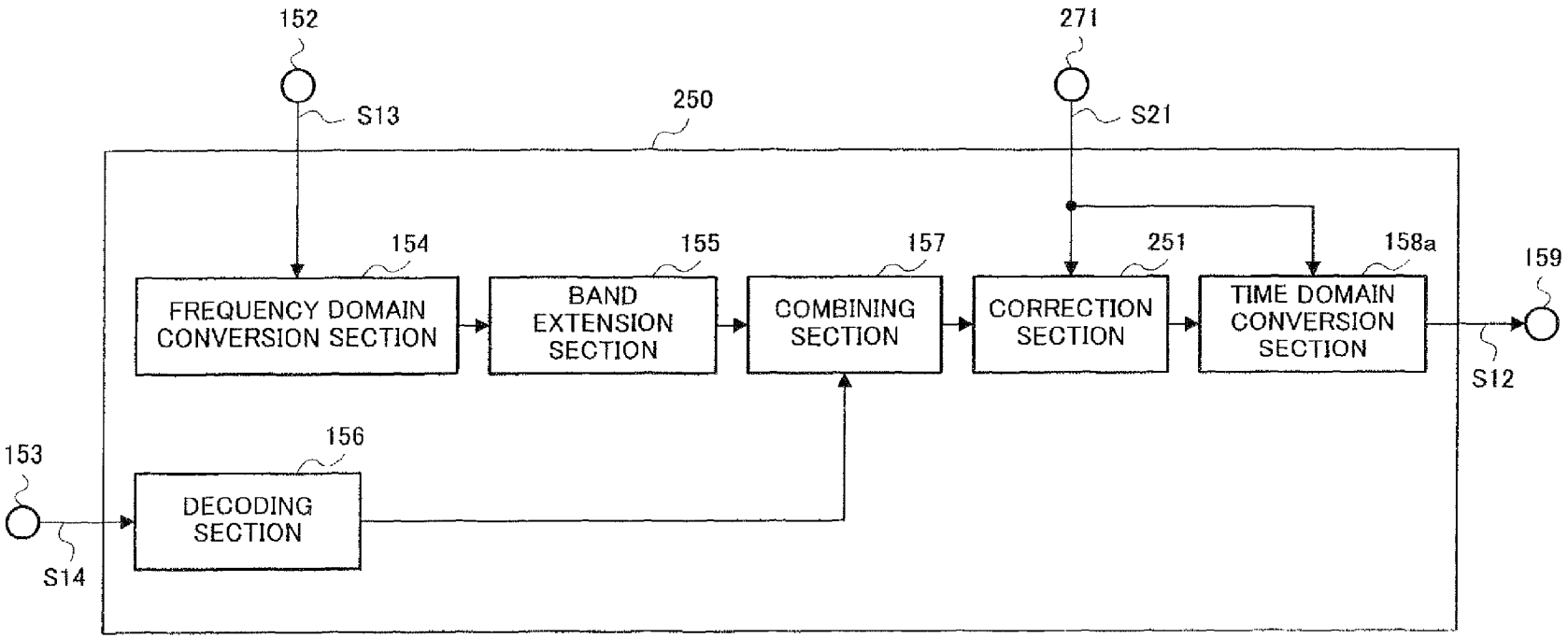
FIG. 16 is a block diagram showing the internal configuration of a spectrum decoding section according to Embodiment 2.

FIG. 16 is a block diagram showing the internal configuration of above described spectrum decoding section 250.

Coefficient Nc input through input terminal 271 is given to correction section 251 and time domain conversion section 158*a*.

Correction section 251 corrects the effective band of first spectrum S1(k)(0≦k<Nb) given from combining section 157 to 0≦k<Nc based on coefficient Nc (signal S21) given through input terminal 271. Correction section 251 then gives first spectrum S1(k)(0≦k<Nc) after the band correction to time domain conversion section 158*a*.

Time domain conversion section 158*a* applies conversion processing to first spectrum S1(k)(0≦k<Nc) given from correction section 251 under an analysis length of 2·Nc according to coefficient Nc given through input terminal 271, performs a multiplication with an appropriate window function and a overlap-add processing, generates a signal in the time domain and outputs it through output terminal 159. The sampling rate of this decoded signal becomes FS=Fx·Nc/Na.

Figure 17:
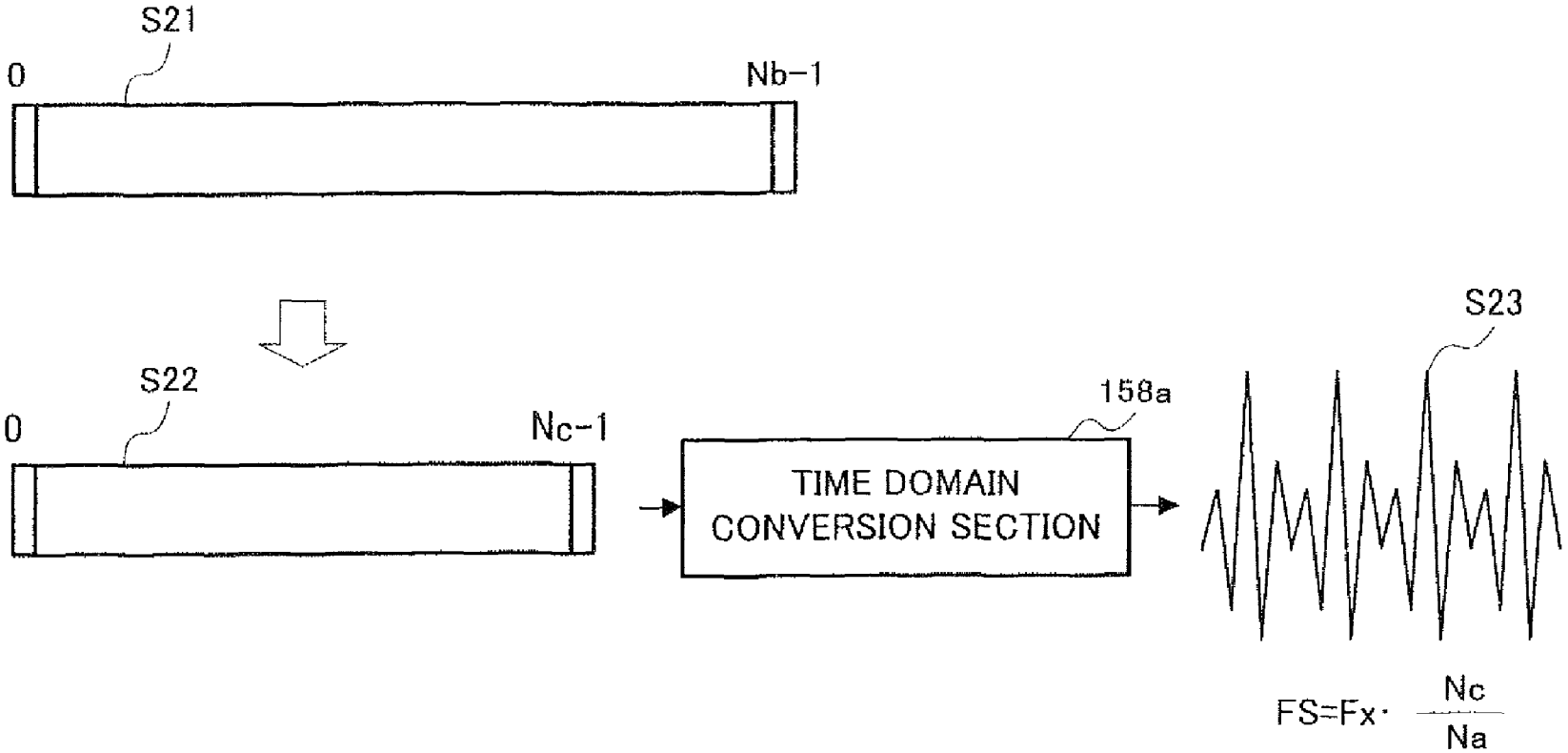
FIG. 17 illustrates processing of a correction section according to Embodiment 2 in more detail.
Figure 18:
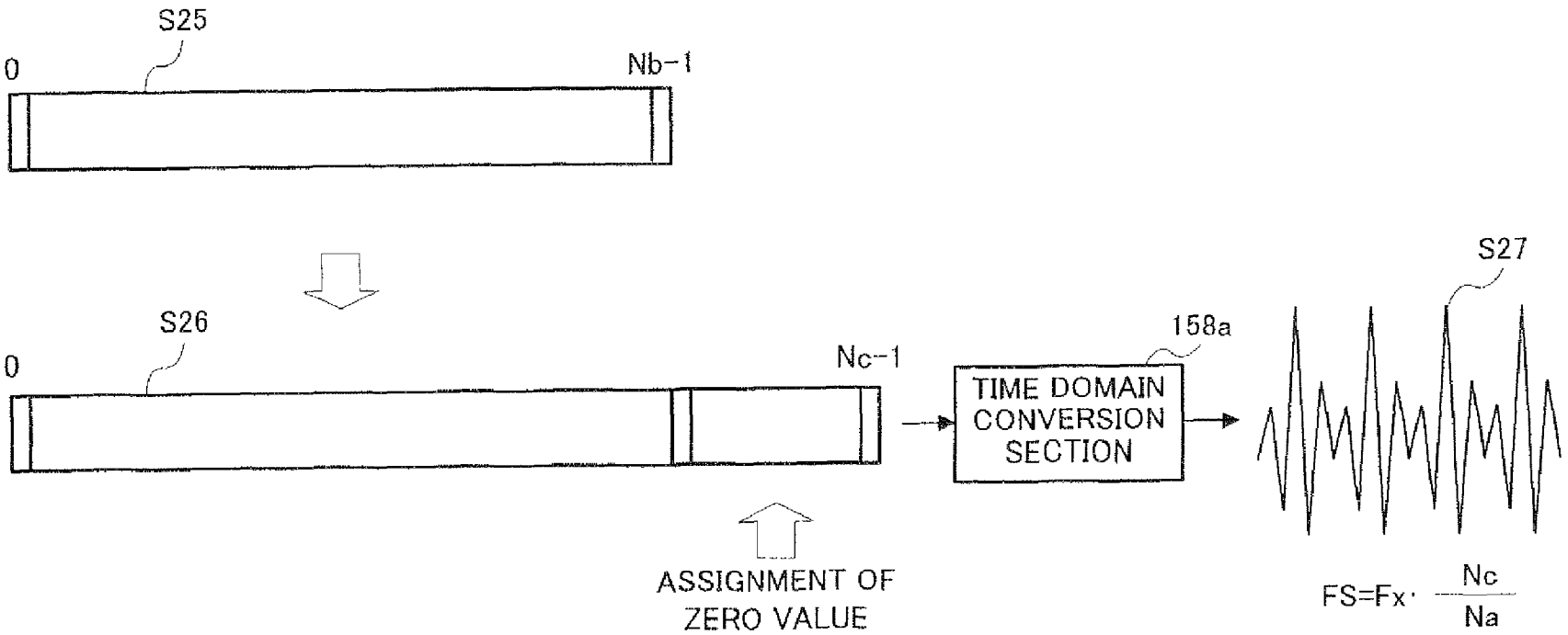
FIG. 18 illustrates processing of the correction section according to Embodiment 2 in more detail.

FIG. 17 and FIG. 18 are diagram illustrating processing by correction section 251 in more detail.

FIG. 17 shows processing by correction section 251 when Nc<Nb. The band of first spectrum S1(k) (signal S21) given from combining section 157 is 0≦k<Nb. Therefore, correction section 251 deletes a spectrum in the range of Nc≦k<Nb so that the band of this first spectrum S1(k) becomes 0≦k<Nc. As a result, first spectrum S1(k)(0≦k<Nc) (signal S22) obtained is given to time domain conversion section 158*a* and decoded signal S23 in the time domain is generated. The sampling rate of this decoded signal S23 becomes FS=Fx·Nc/Na.

FIG. 18 also shows processing by correction section 251, but in this case Nc>Nb. The band of first spectrum S1(k) (signal S25) given from combining section 251 is 0≦k<Nb as in the case of FIG. 17. Correction section 251 extends the band of Nb≦k<Nc so that the band of this first spectrum S1(k) becomes 0≦k<Nc and assigns a specific value (e.g. zero) to the area. As a result, first spectrum S1(k)(0≦k<Nc) (signal S26) is given to time domain conversion section 158*a* and decoded signal S27 in the time domain is generated. The sampling rate of this decoded signal S27 becomes FS=Fx·Nc/Na.

Figure 19:
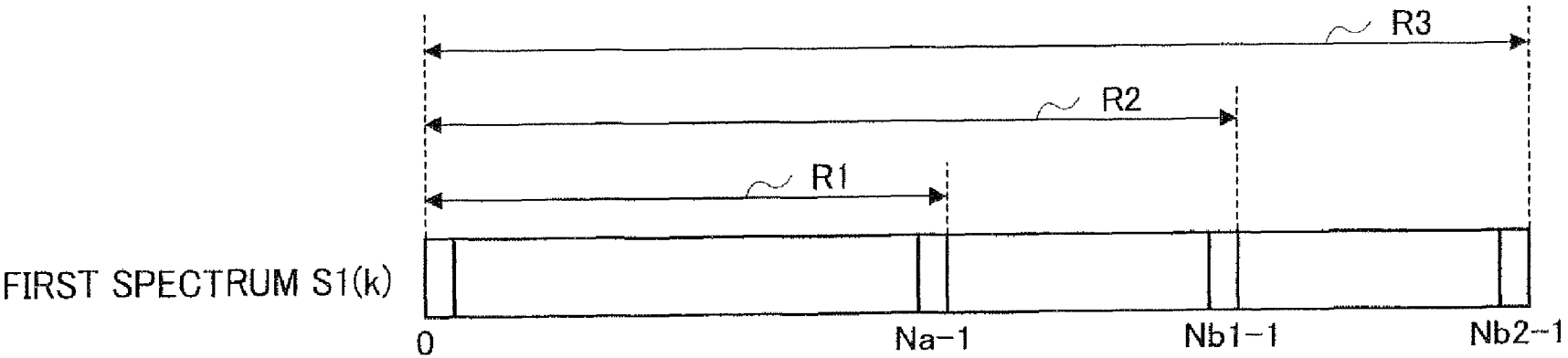
FIG. 19 further illustrates the operation of the spectrum decoding section according to Embodiment 2.
Figure 20A:
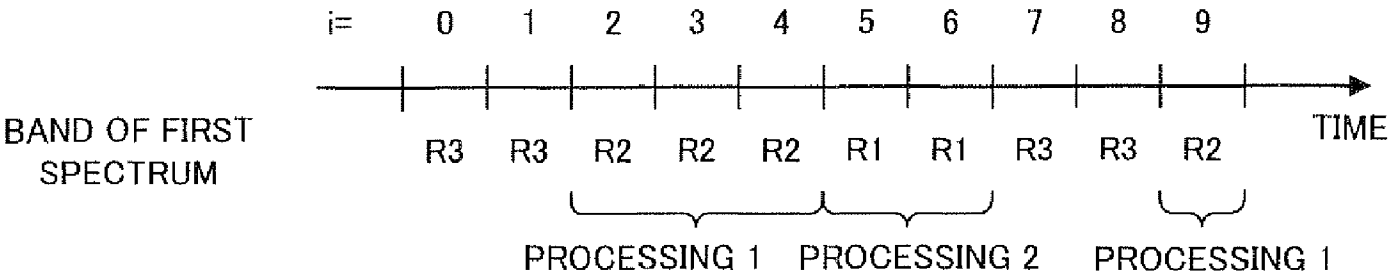
FIG. 20A further illustrates the operation of the spectrum decoding section according to Embodiment 2.
Figure 20B:
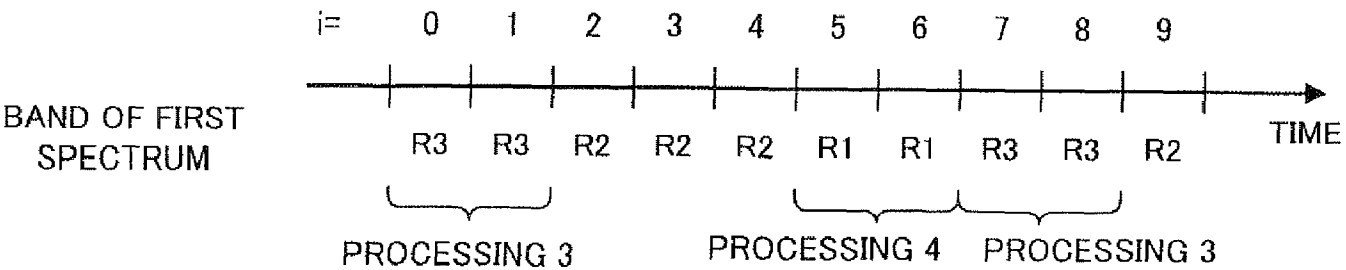
FIG. 20B further illustrates the operation of the spectrum decoding section according to Embodiment 2.

The operation of spectrum decoding section 250 will be further explained using FIG. 19, FIG. 20A and FIG. 20B.

First, suppose that the code input through input terminal 153 changes from one frame to another. That is, suppose that there are three bands in the band from combining section 157 as shown in FIG. 19; 0≦k<Na (band R1), 0≦k<Nb1 (band R2), 0≦k<Nb2 (band R3) (note that Na<Nb1<Nb2) and one of these bands is selected for each frame.

FIG. 20A illustrates the operation of the spectrum decoding section 250 when coefficient Nc is equal to Nb2, and FIG. 20B illustrates the operation of spectrum decoding section 250 when coefficient Nc is equal to Nb1.

These figures express that the band of the spectrum obtained in the i-th frame is any one of R1, R2, R3. Furthermore, processing 1 shows the processing of inserting a zero value in the band of Nb1≦k<Nb2, processing 2 shows the processing of inserting a zero value in the band of Na≦k<Nb2, processing 3 shows the processing of deleting the band of Nb1≦k<Nb2 and processing 4 shows the processing of inserting a zero value in the band of Na≦k<Nb1.

First, the case of FIG. 20A will be explained.

In this figure, in the 0th frame to the 1st frame and the 7th frame to the 8th frame, since the band of the spectrum is R3, that is, the band of first spectrum S1(k) is 0≦k<Nb2, and therefore correction section 251 outputs first spectrum S1(k) (0≦k<Nb2) to time domain conversion section 158*a* without applying any processing.

Furthermore, in the 2nd frame to the 4th frame and the 9th frame, since the band of the spectrum is R2, that is, the band of first spectrum S1(k) is 0≦k<Nb1, correction section 251 extends the band of first spectrum S1(k) to Nb2, inserts a zero value in the band of Nb1≦k<Nb2 and then outputs first spectrum S1(k)(0≦k<Nb2) to time domain conversion section 158*a*.

On the other hand, the band of the spectrum is R1 in the 5th frame to the 6th frame, that is, the band of first spectrum S1(k) is 0≦k<Na, and therefore correction section 251 extends the band of first spectrum S1(k) to Nb2, inserts a zero value in the range of Na≦k<Nb2 and then outputs first spectrum S1(k) (0≦k<Nb2) to time domain conversion section 158*a*.

Next, the case of FIG. 20B will be explained.

In this figure, in the 2nd frame to the 4th frame and the 9th frame, the band of the spectrum is R2, that is, the band of first spectrum S1(k) is 0≦k<Nb1, and therefore correction section 251 outputs first spectrum S1(k)(0≦k<Nb1) to time domain conversion section 158*a* without applying any processing.

Furthermore, in the 0th frame to the 1st frame, and the 7th frame to the 8th frame, the band of the spectrum is R3, that is, the band of first spectrum S1(k) is 0≦k<Nb2, correction section 251 deletes the band of Nb1≦k<Nb2, and then outputs first spectrum S1(k)(0≦k<Nb1) to time domain conversion section 158*a*.

On the other hand, in the 5th frame to the 6th frame, the band of the spectrum is R1, that is, the band of first spectrum S1(k) is 0≦k<Na, and therefore correction section 251 extends the band of first spectrum S1(k) to Nb1, inserts a zero value in the band of Na≦k<Nb1, and then outputs first spectrum S1(k)(0≦k<Nb1) to time domain conversion section 158*a*.

According to the this embodiment, even when the effective frequency band of received first spectrum S1(k) changes temporally, appropriate coefficient Nc is given in this way, and it is possible to thereby obtain a decoded signal at a desired sampling rate stably.

(Embodiment 3)

Figure 21:
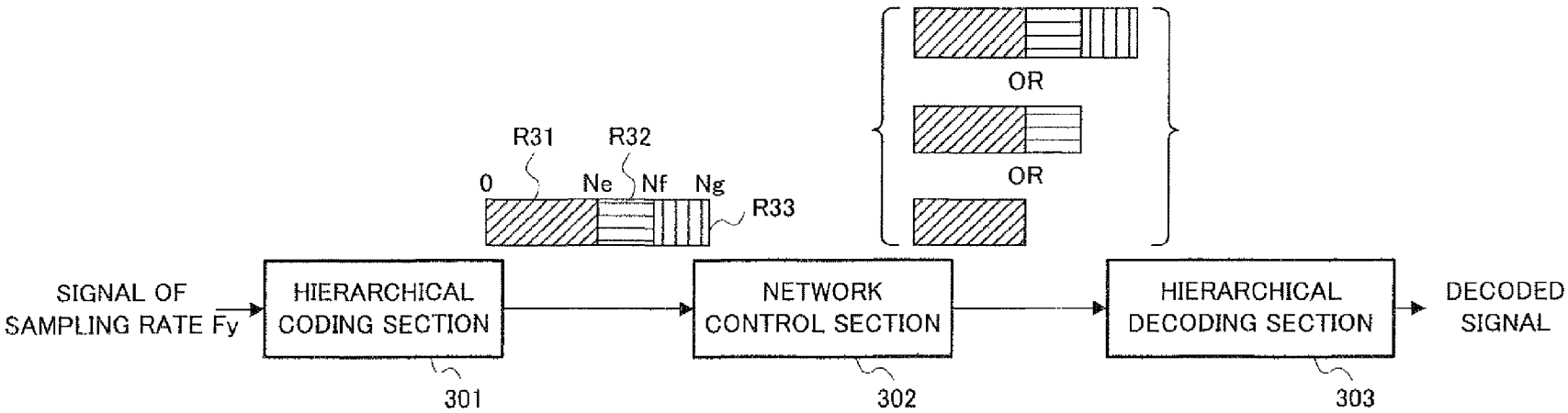
FIG. 21 shows the main configuration of a communications system according to Embodiment 3.

FIG. 21 shows the main configuration of a communications system according to of Embodiment 3 of the present invention.

A feature of this embodiment is to deal with a case where the effective frequency band of first spectrum S1(k) received on the receiving side changes temporally depending on the condition of the communication network (communication environment).

Hierarchical coding section 301 applies the hierarchical coding processing shown in Embodiment 1 to the input signal of sampling rate Fy and generates a scalable code. Here, suppose the generated code is made up of information (R31) on band 0≦k<Ne, information (R32) on band Ne≦k<Nf and information (R33) on band Nf≦k<Ng. Hierarchical coding section 301 gives this code to network control section 302.

Network control section 302 transfers a code given to from hierarchical coding section 301 to hierarchical decoding section 303. Here, network control section 302 discards part of the code to be transferred to hierarchical decoding section 303 according to the condition of the network. For this reason, the code to be input to hierarchical decoding section 303 is any one of the code made up of information R31 to R33 when there is no code to be discarded, the code made up of information R31 and R32 when the code of information R33 is discarded and the code made up of information R31 when the code of information R32 and R33 is discarded.

Hierarchical decoding section 303 applies the hierarchical decoding method shown in Embodiment 1 or Embodiment 2 to a given code and generates a decoded signal. When Embodiment 1 is applied to hierarchical decoding section 303, sampling rate Fz of the output decoded signal becomes Fy (because Fz=Fy·Ng/Ng). Furthermore, when Embodiment 2 is applied to hierarchical decoding section 303, it is possible to set the sampling rate of the decoded signal according to desired coefficient Nc, and sampling rate Fz of the decoded signal becomes Fy·Nc/Ng.

In this way, according to the this embodiment, even when the effective frequency band of first spectrum S1(k) received on the receiving side changes temporally depending on the condition of the communication network, the receiving side can obtain the decoded signal of a desired sampling rate stably.

(Embodiment 4)

Figure 22:
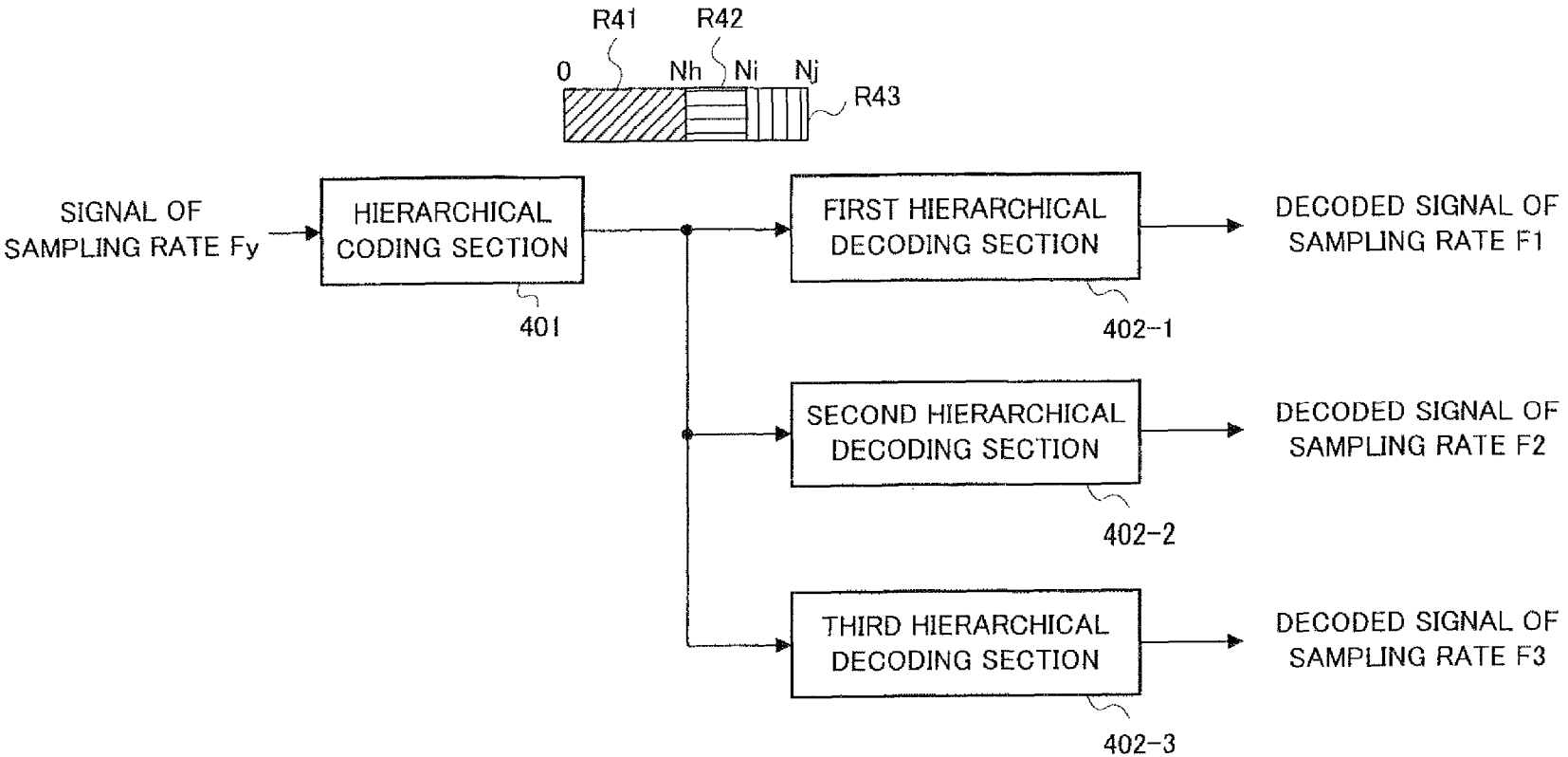
FIG. 22 shows the main configuration of a communications system according to Embodiment 4.

FIG. 22 shows the main configuration of a communications system according to Embodiment 4 of the present invention.

A feature of this embodiment is that even when one code generated by one hierarchical coding section is simultaneously transmitted to plural hierarchical decoding sections having different decodable sampling rates (different decoding capacities), the receiving side can handle the code and obtain decoded signals having different sampling rates.

Hierarchical coding section 401 applies the coding processing shown in Embodiment 1 to the input signal of sampling rate Fy and generates a scalable code. Here, suppose the generated code is made up of information (R41) on band 0≦k<Nh, information (R42) on band Nh≦k<Ni and information (R43) on band Ni≦k<Nj. Hierarchical coding section 401 gives this code to first hierarchical decoding section 402-1, second hierarchical decoding section 402-2 and third hierarchical decoding section 402-3 respectively.

First hierarchical decoding section 402-1, second hierarchical decoding section 402-2 and third hierarchical decoding section 402-3 apply the hierarchical decoding method shown in Embodiment 1 or Embodiment 2 to a given code and generate a decoded signal. First hierarchical decoding section 402-1 performs decoding processing when coefficient Nc=Nj, second hierarchical decoding section 402-2 performs decoding processing of when coefficient Nc=N1 and third hierarchical decoding section 402-3 performs decoding processing of when coefficient Nc=Nh.

First hierarchical decoding section 402-1 performs decoding processing of when coefficient Nc=Nj and generates a decoded signal. Sampling rate F1 of this decoded signal becomes Fy (because F1=Fy·Nj/Nj).

Second hierarchical decoding section 402-2 performs decoding processing of when coefficient Nc=Ni and generates a decoded signal. Sampling rate F2 of this decoded signal becomes Fy·Ni/Nj.

Third hierarchical decoding section 402-3 performs decoding processing of when coefficient Nc=Nh and generates a decoded signal. Sampling rate F3 of this decoded signal becomes Fy·Nh/Nj.

In this way, according to this embodiment, the transmitting side can transmit a code without considering the decoding capacity on the receiving side, and therefore it is possible to suppress the load of a communication network. Furthermore, decoded signals having plural types of sampling rates can be generated in a simple configuration and with a smaller amount of calculation.

The coding apparatus or the decoding apparatus according to the present invention can also be mounted on a communication terminal apparatus and a base station apparatus in a mobile communications system, and it is possible to thereby provide a communication terminal apparatus and a base station apparatus having operations and effects similar to those described above.

Here, the case where the present invention is constructed by hardware has been explained as an example but the present invention can also be realized by software.

The present application is based on Japanese Patent Application No. 2003-341717 filed on Sep. 30, 2003, entire content of which is expressly incorporated by reference herein.

Industrial Applicability

The coding apparatus and the decoding apparatus according to the present invention have the effect of realizing scalable coding in a simple configuration and with a small amount of calculation and are suitable for use in a communications system such as an IP network.

The invention claimed is:

1. A scalable coding apparatus comprising:

a first coding section that encodes a first band of a voice signal or audio signal; and a second coding section that encodes a second band of said voice signal or said audio signal, wherein said second coding section comprises a sampling rate conversion section including:

an acquisition section that acquires a first spectrum from a time domain signal having a first sampling rate obtained by said first coding section through a frequency domain conversion; and a generation section that generates an extended spectrum based on said first spectrum, which is added to said first spectrum and extends the bandwidth of said first spectrum, wherein said extended spectrum has a bandwidth calculated by a ratio of said first sampling rate and a second sampling rate which is higher than said first sampling rate, and the shape of said extended spectrum is most similar to the shape of a second band of said voice signal or audio signal.

2. The scalable coding apparatus according to claim 1, wherein:

said generation section generates said extended spectrum by copying a part of said first spectrum, and a location of said part of said first spectrum is determined from a predetermined range so that the shape of said extended spectrum is most similar to the shape of a second band of said voice signal or audio signal.

3. The scalable coding apparatus according to claim 1, wherein said second coding section divides said extended spectrum into two or more subbands and performs coding in subband units.

4. The scalable coding apparatus according to claim 1, wherein:

the acquisition section acquires a first spectrum from the time domain signal having the first sampling rate, Fx; and the generation section generates said extended spectrum with a bandwidth of Nb-Na, based on the ratio of said first sampling rate and the second sampling rate, Fy, in accordance with the following expression:

$$Nb = Na \cdot \frac{Fy}{Fx}$$

where

Na is the bandwidth of the spectrum before extending, and Nb is the bandwidth of the spectrum after extending.

5. The scalable coding apparatus according to claim 1, further comprising a gain determining section that determines a gain of said extended spectrum whose bandwidth is extended so as to match power in the second band of said voice signal or said audio signal.

6. A communication terminal apparatus comprising the scalable coding apparatus according to claim 1.

7. A base station apparatus comprising the scalable coding apparatus according to claim 1.

8. A scalable decoding apparatus comprising:

a first decoding section that decodes a coding information generated by encoding an voice or audio signal by a scalable coding apparatus to generate a decoded first band of a voice signal or audio signal; and a second decoding section that decodes said coding information to generate a decoded second band of said voice signal or said audio signal, wherein said second decoding section comprises a sampling rate conversion section including:

an acquisition section that acquires a first spectrum from a time domain signal having a first sampling rate obtained by said first decoding section through a frequency domain conversion: and a generation section that generates an extended spectrum based on said first spectrum, which is added to said first spectrum and extends the bandwidth of said first spectrum, wherein said extended spectrum has a bandwidth calculated by a ratio of said first sampling rate and a second sampling rate which is higher than said first sampling rate, and the shape of said extended spectrum is most similar to the shape of a second band of said voice signal or audio signal.

9. The scalable decoding apparatus according to claim 8, wherein:

said generation section generates said extended spectrum by copying a part of said first spectrum, and a location of said part of said first spectrum is determined from a predetermined range so that the shape of said extended spectrum is most similar to the shape of a second band of said voice signal or audio signal.

10. The scalable decoding apparatus according to claim 8, wherein said extended spectrum is divided into two or more subbands and includes coding information of said extended spectrum which is coded in subband units.

11. The scalable decoding apparatus according to claim 8, wherein:

the acquisition section acquires the first spectrum from the time domain signal having the first sampling rate, Fx; and the generation section generates the extended spectrum with a bandwidth of Nb-Na, based on the ratio of said first sampling rate and the second sampling rate, Fy, in accordance with the following expression:

$$Nb = Na \cdot \frac{Fy}{Fx}$$

where

Na is the bandwidth of the spectrum before extending, and

Nb is the bandwidth of the spectrum after extending.

12. The scalable decoding apparatus according to claim 8, further comprising a gain determining section that determines a gain of said extended spectrum whose bandwidth is extended so as to match power in the second band of said voice signal or said audio signal.

13. The scalable decoding apparatus according to claim 8, further comprising a third decoding section that decodes a third band of said voice signal or said audio signal, wherein said third decoding section generates a spectrum from a time domain signal of said first sampling rate, applies processing such as zero insertion or deletion to the high frequency part of the spectrum, obtains a spectrum of said third band and converts the spectrum of said third band to a time domain signal.

14. A communication terminal apparatus comprising the scalable decoding apparatus according to claim 8.

15. A base station apparatus comprising the scalable decoding apparatus according to claim 8.

16. A scalable coding method comprising:

a first coding step of encoding a first band of a voice signal or audio signal; and a second coding step of encoding a second band of said voice signal or said audio signal, wherein said second coding step comprises a sampling rate conversion operation including:

an acquisition step of acquiring a first spectrum from a time domain signal having a first sampling rate obtained in said first coding step through a frequency domain conversion; and a generation step of generating an extended spectrum based on said first spectrum, which is added to said first spectrum and extends the bandwidth of said first spectrum, wherein said extended spectrum has a bandwidth calculated by a ratio of said first sampling rate and a second sampling rate which is higher than said first sampling rate, and the shape of said extended spectrum is most similar to the shape of a second band of said voice signal or audio signal.

17. The scalable coding method according to claim 16, wherein:

the acquisition step acquires a first spectrum from the time domain signal having the first sampling rate, Fx; and the generation step generates said extended spectrum with a bandwidth of Nb-Na, based on the ratio of said first sampling rate and the second sampling rate, Fy, in accordance with the following expression:

$$Nb = Na \cdot \frac{Fy}{Fx}$$

where

Na is the bandwidth of the spectrum before extending, and

Nb is the bandwidth of the spectrum after extending.

18. A scalable decoding method comprising:

a first decoding step of decoding a coding information generated by encoding an voice or audio signal by a scalable coding apparatus to generate a decoded first band of a voice signal or audio signal; and a second decoding step of decoding said coding information to generate a decoded second band of said voice signal or said audio signal, wherein said second decoding step comprises a sampling rate conversion operation including:

an acquisition step of acquiring a first spectrum from a time domain signal having a first sampling rate obtained in said first decoding step through a frequency domain conversion: and a generation step of generating an extended spectrum based on said first spectrum, which is added to said first spectrum and extends the bandwidth of said first spectrum, wherein said extended spectrum has a bandwidth calculated by a ratio of said first sampling rate and a second sampling rate which is higher than said first sampling rate, and the shape of said extended spectrum is most similar to the shape of a second band of said voice signal or audio signal.

19. The scalable decoding method according to claim 18, wherein:

the acquisition step acquires the first spectrum from the time domain signal having the first sampling rate, Fx; and the generation step generates said extended spectrum with a bandwidth of Nb-Na, based on the ratio of said first sampling rate and the second sampling rate, Fy, in accordance with the following expression:

$$Nb = Na \cdot \frac{Fy}{Fx}$$

where

Na is the bandwidth of the spectrum before extending, and

Nb is the bandwidth of the spectrum after extending.

* * * * *

UNITED STATES PATENT AND TRADEMARK OFFICE

CERTIFICATE OF CORRECTION

PATENT NO. : 8,195,471 B2
APPLICATION NO. : 12/708290
DATED : June 5, 2012
INVENTOR(S) : Masahiro Oshikiri It is certified that error appears in the above-identified patent and that said Letters Patent is hereby corrected as shown below:

On the title page item (75),

Inventor Masahiro Oshikiri's city of residence incorrectly reads:

"Osaka"

and should read:

"Yokosuka-shi".

Item (56) References Cited, Foreign Patent Documents, page 2, line 6, incorrectly reads:

" JP.....2003-502704.....1/2000"

and should read:

"JP.....2003-502704.....1/2003".

Item (56) References Cited, Other Publications, page 2, column 1, line 14, incorrectly reads: "Yuichiro Takamizawa et al., "MPEG-4 Audio Taliki Kakucho"

and should read:

"Yuichiro Takamizawa et al., "MPEG-4 Audio Taiiki Kakucho".

Signed and Sealed this
Second Day of July, 2013

Teresa Stanek Rea
*Acting Director of the United States Patent and Trademark Office*

Item (56) References Cited, Other Publications, page 2, column 1, line 16, incorrectly reads:

"ics, Information and Communication Engineers Sogo Taikai Keen"

and should read:

"ics, Information and Communication Engineers Sogo Taikai Koen"

Item (56) References Cited, Other Publications, page 2, column 2, line 11, incorrectly reads:

"Hoshiki," FIT 2003 Joho Kagaku Gijutsu Forum Keen Ronbunshu,"

and should read:

"Hoshiki," FIT 2003 Joho Kagaku Gijutsu Forum Koen Ronbunshu,".

Item (56) References Cited, Other Publications, page 2, column 2, line 17, incorrectly reads:

"Electronics, Information and Communication Engineers Sago Taikai"

and should read:

"Electronics, Information and Communication Engineers Sogo Taikai".

Item (56) References Cited, Other Publications, page 2, column 2, line 25, incorrectly reads:

"Gijutsu o Mochita 7/10/15kHz Taikai Scalable Onset Fugoka"

and should read:

"Gijutsu o Mochita 7/10/15kHz Taikai Scalable Onsei Fugoka".

In the Claims

Claim 1, column 18, line 25, incorrectly reads:

"similar to the shape of a second band of said voice signal"

and should read:

"similar to the shape of the second band of said voice signal".

Claim 2, column 18, line 33, incorrectly reads:

"spectrum is most similar to the shape of a second band of"

and should read:

"spectrum is most similar to the shape of the second band of".

Claim 8, column 18, line 67, incorrectly reads:

"generated by encoding an voice or audio signal by a"

and should read:

"generated by encoding a voice or audio signal by a".

Claim 9, column 19, line 29, incorrectly reads:

"spectrum is most similar to the shape of a second band of"

and should read:

"spectrum is most similar to the shape of the second band of".

Claim 16, column 20, line 25, incorrectly reads:

"similar to the shape of a second band of said voice signal"

and should read:

"similar to the shape of the second band of said voice signal".

Claim 18, column 20, line 46, incorrectly reads:

"generated by encoding an voice or audio signal by a"

and should read:

"generated by encoding a voice or audio signal by a".